US011148182B2

(12) United States Patent
Haraguchi et al.

(10) Patent No.: US 11,148,182 B2
(45) Date of Patent: Oct. 19, 2021

(54) COOLING DEVICE FOR HOT ROLLED STEEL SHEET AND COOLING METHOD FOR THE SAME

(71) Applicant: NIPPON STEEL CORPORATION, Tokyo (JP)

(72) Inventors: Yohichi Haraguchi, Tokyo (JP); Yoshihiro Serizawa, Tokyo (JP); Tatsuro Honda, Tokyo (JP); Hisayoshi Tachibana, Tokyo (JP); Susumu Nakagawa, Tokyo (JP); Koki Tanaka, Tokyo (JP); Shota Ishitsuka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 162 days.

(21) Appl. No.: 16/484,765

(22) PCT Filed: Mar. 31, 2017

(86) PCT No.: PCT/JP2017/013865
§ 371 (c)(1),
(2) Date: Aug. 8, 2019

(87) PCT Pub. No.: WO2018/179449
PCT Pub. Date: Oct. 4, 2018

(65) Prior Publication Data
US 2020/0055105 A1 Feb. 20, 2020

(51) Int. Cl.
*B21B 37/74* (2006.01)
*B21B 45/02* (2006.01)
*B21C 51/00* (2006.01)

(52) U.S. Cl.
CPC ..... *B21B 37/74* (2013.01); *B21B 45/0233* (2013.01); *B21B 45/0218* (2013.01);
(Continued)

(58) Field of Classification Search
CPC . B21B 37/74; B21B 45/0203; B21B 45/0209; B21B 2045/0212;
(Continued)

(56) References Cited

U.S. PATENT DOCUMENTS 4,371,149 A * 2/1983 Takeuchi ..... C21D 1/667 266/113
4,785,646 A 11/1988 Uekaji et al.
(Continued)

FOREIGN PATENT DOCUMENTS

EP 1 634 657 A1 3/2006
JP 58-81010 U 6/1983
(Continued)

OTHER PUBLICATIONS

International Search Report for PCT/JP2017/013865 (PCT/ISA/210) dated Jul. 4, 2017.

*Primary Examiner* — Edward T Tolan
(74) *Attorney, Agent, or Firm* — Birch, Stewart, Kolasch & Birch, LLP.

(57) ABSTRACT

A cooling device cooling an undersurface of a hot rolled steel sheet that is being transported on transport rolls after finish rolling of a hot rolling step includes: width divided cooling zones that are a plurality of cooling zones into which a whole cooling zone is divided in a sheet width direction; divided cooling sections that are a plurality of cooling zones into which each of the width divided cooling zones is divided in the rolling direction; a water nozzle spraying cooling water over each of undersurfaces of the divided cooling sections; a switching mechanism switching the cooling water between impinging and not impinging on the divided cooling sections; a width direction thermometer
(Continued)

measuring a temperature distribution in the sheet width direction; and a controller controlling operation of the switching mechanism.

11 Claims, 24 Drawing Sheets

(52) U.S. Cl.
CPC ..... *B21B 2261/21* (2013.01); *B21B 2263/08* (2013.01); *B21C 51/00* (2013.01)

(58) Field of Classification Search
CPC ..... B21B 45/0215; B21B 45/0218; B21B 45/0233; B21B 2261/20; C21D 1/667
See application file for complete search history.

(56) References Cited

U.S. PATENT DOCUMENTS

| | | | | |
|---|---|---|---|---|
| 2009/0019907 | A1* | 1/2009 | Ueoka | B21B 45/0218 72/201 |
| 2009/0121396 | A1 | 5/2009 | Serizawa et al. | |
| 2010/0044024 | A1* | 2/2010 | Beeston | B21B 45/0233 165/185 |
| 2010/0132426 | A1 | 6/2010 | Baumgärtel et al. | |
| 2011/0162427 | A1* | 7/2011 | Nakata | B21B 45/0233 72/201 |
| 2011/0208345 | A1 | 8/2011 | Söderlund | |
| 2012/0067470 | A1 | 3/2012 | Serizawa et al. | |
| 2012/0297849 | A1* | 11/2012 | Berchem | B21B 45/0203 72/201 |
| 2015/0321234 | A1* | 11/2015 | Ueoka | B21B 45/0218 72/201 |
| 2016/0052034 | A1 | 2/2016 | Chen et al. | |

FOREIGN PATENT DOCUMENTS

| | | | |
|---|---|---|---|
| JP | 62-25049 | B2 | 6/1987 |
| JP | 62-142017 | A | 6/1987 |
| JP | 1-159911 | U | 11/1989 |
| JP | 6-71328 | A | 3/1994 |
| JP | 7-314028 | A | 12/1995 |
| JP | 11-244926 | A | 9/1999 |
| JP | 3818501 | B2 | 9/2006 |
| JP | 2010-527797 | A | 8/2010 |
| KR | 10-2008-0089600 | A | 10/2008 |
| KR | 10-1481616 | B1 | 1/2015 |
| TW | 200523046 | A | 7/2005 |
| TW | I393598 | B1 | 4/2013 |
| TW | I472383 | B | 2/2015 |
| WO | WO 2008/145222 | A1 | 12/2008 |
| WO | WO 2009/024644 | A1 | 2/2009 |

* cited by examiner

COOLING DEVICE FOR HOT ROLLED STEEL SHEET AND COOLING METHOD FOR THE SAME

TECHNICAL FIELD

The present invention relates to cooling devices cooling an undersurface of a hot rolled steel sheet being transported on transport rolls after finish rolling in a hot rolling step, and cooling methods using the cooling devices.

BACKGROUND ART

The high tensile steel sheet has been highly demanded among hot rolled steel sheets as vehicles have been lightened in recent years, which has led to the demand for hot rolled steel sheets of a further high quality. Especially in recent years, not only high strength but also the following have been demanded: excellent processability of press formability, hole expandability, etc.; variations of mechanical characteristics including tensile strength and processability within a predetermined range all over a steel sheet; etc.

An uneven temperature distribution may appear on a hot rolled steel sheet in the sheet width direction due to various factors when the sheet is cooled after finish rolling. Specific examples thereof include the appearance of a stripe of an uneven temperature distribution on a hot rolled steel sheet in the sheet width direction which extends in a rolling direction thereof. Examples of factors therein include: scale that is the remainder originating from descaling during or before finish rolling; the remainder of a lubricant sprinkled during finish rolling which is distributed in the sheet width direction; non-homogeneity on cooling water sprays provided between finish rolling stands; and a heating furnace, all of which are before cooling after finish rolling. An uneven temperature distribution may also appear during cooling after finish rolling due to a poorly-maintained cooling device etc.

A winding temperature is one of factors largely influencing characteristics of final products as described above in a manufacturing process of hot rolled steel sheets. For improving the quality of the steel sheet, it is therefore important to have a more uniform winding temperature all over a steel sheet. Here, a winding temperature is a temperature of a steel sheet just before a winding device if the steel sheet is wound after a cooling step after finish rolling.

In a cooling step of spraying cooling water over a steel sheet of a high temperature of 800° C. to 900° C. after finish rolling, generally, vapor generated by film boiling stably covers the surface of the steel sheet until the temperature of the steel sheet is approximately 600° C. or higher, which makes the cooling capacity itself of the cooling water low, but makes it comparatively easy to uniformly cool the surface of the steel sheet all over.

The volume of the vapor starts decreasing especially as the temperature of the steel sheet falls approximately below 550° C. The vapor film covering the surface of the steel sheet starts to decay, and a transition boiling region where the distribution of the vapor film temporally and spatially varies is formed, which results in more ununiform cooling, and rapid and easy expansion of unevenness in the temperature distribution in the steel sheet in the sheet width direction and the rolling direction. This makes it difficult to control the temperature of the steel sheet, and to finish cooling the whole of the steel sheet just at the target winding temperature.

For manufacturing products having excellent properties of both strength and processability, it is effective to lower a winding temperature into a low temperature range of no more than 500° C. It is very important therefore that ununiformity in a winding temperature all over a steel sheet including its distribution in the sheet width direction and the longitudinal direction is within a predetermined range with respect to the target temperature. From viewpoints as described above, a lot of inventions for controlling a winding temperature have been made so far.

Most of these inventions relate to methods and means for measures against ununiform cooling caused by a cooling device itself. Various measures are taken especially for hot rolled steel sheets because a big problem is raised by ununiform cooling in the sheet width direction which is caused by cooling water sprayed over the upper surface of the steel sheet left over the steel sheet. Other than them, one may also find that some inventions have an object of suppressing ununiform cooling caused by factors other than a cooling device especially by an uneven temperature distribution in the sheet width direction and the longitudinal direction before cooling or by ununiformity in a surface property such as surface roughness of a steel sheet and the thickness of scale. That is, especially when a winding temperature is within a low temperature range, an uneven temperature distribution before cooling leads to earlier decay of a vapor film over a portion of lower temperatures to form a transition boiling region, and this portion is rapidly cooled, which raises a problem of a temperature deviation after cooling more than that on the upstream side of a cooling device. By the influence of an ununiform surface property as well, a vapor film over a portion of a much surface roughness or having thick scale selectively decays earlier, which also raises a problem of a temperature deviation after cooling several times as much as that on the upstream side of a cooling device.

It is the most desirable as measures against such ununiform cooling caused by a ununiform temperature and/or surface property before cooling to provide some means so as to sufficiently suppress this ununiformity before cooling. Actually, many inventions relating to such measures have been made. Productivity and costs are also important however for mass production facilities such as a manufacturing line of hot rolled steel sheets. Even if measures for making temperature and surface properties before cooling less ununiform are present, it is practically very difficult to thoroughly take such measures until problems after cooling are completely solved while the well-balanced costs as a whole are achieved. In some cases, radical measures have not been found yet because most causes for an ununiform surface property mechanistically have not been made clear.

It can be considered as another means for dealing with ununiformity before cooling to make a temperature distribution after cooling even by selectively limiting a cooling capacity for a portion of lower temperatures or by increasing a cooling capacity for a portion of higher temperatures based on information on a temperature distribution before or in the middle of cooling. It can be also considered that a temperature distribution after cooling can be made to be even as follows: an ununiform surface property due to scale etc. cannot be always grasped from information on a temperature distribution before cooling, but the influence thereof is often reflected on a temperature distribution in the middle of cooling; thus, a temperature distribution is measured at a proper timing, that is, at a timing before decay of a vapor film progresses on a full scale to lead to a fatal uneven temperature distribution; and a cooling capacity is controlled on the basis of the information thereon.

Then, inventions as follows have been made so far.

For example, Patent Literature 1 discloses a method for cooling a steel sheet with a spray width controller, the method including: controlling an internal pressure of a control cylinder in accordance with a position of a piston rod moving along a screw rotated by a variable motor; and controlling jets of cooling water from spray nozzles, the control cylinder being provided for a spray header where the spray nozzles are aligned, the control cylinder supplying a pilot pressure that turns on and off an open close valve incorporated in each of the spray nozzles, wherein the pilot pressure for operating the open close valve in a specific one of the spray nozzles is adjusted to form an edge mask, or a front and tail masks, the specific one being set in advance.

Patent Literature 2 discloses a cooling device for a steel tube including: a spraying device spraying fluid over cooling water that jets out toward the steel tube, to change the direction of the flow of the cooling water so that the flow does not impinge on the steel tube; and a bucket receiving the cooling water, the direction of the flow of the cooling water being changed by the spraying device.

Patent Literature 3 discloses a cooling device for a hot rolled material including: a header of a circular pipe having a slit out of which a platelike water flow can be spouted upward, and a width adjustment member having a recess part gradually covering the spouted water flow from an end of the flow toward the center thereof in the width direction, the width adjustment member being rotatable concentrically to the header.

Patent Literature 4 discloses a cooling device including a plurality of nozzles for applying a cooling medium to a hot rolled steel sheet, the nozzles being arranged both above and underneath the hot rolled steel sheet in the width direction, the nozzles being controlled in such a way that the cooling medium is applied, in particular, at positions at which an elevated temperature may be determined, the cooling device further including a plurality of temperature sensors provided in the width direction thereof, the temperature sensors determining temperature distribution in the hot rolled steel sheet in the width direction so that the nozzles may be controlled in dependence on signals of the temperature sensors.

Patent Literature 5 discloses a cooling device including a plurality of cooling water headers arranged above a hot rolled steel sheet in the width direction, a group of a plurality of cooling water supply nozzles being linearly arranged in each of the cooling water headers, wherein the flow rate of cooling water is controlled based on a temperature distribution measured with a temperature distribution sensor that detects a temperature distribution in the sheet width direction. Specifically, on-off controlling valves are provided for the cooling water headers to control the cooling water

CITATION LIST

Patent Literature

Patent Literature 1: JP H7-314028 A
Patent Literature 2: JP S58-81010 U
Patent Literature 3: JP S62-25049 B2
Patent Literature 4: JP 2010-527797 A
Patent Literature 5: JP H6-71328 A

SUMMARY OF INVENTION

Technical Problem

For switching between start and stop of spraying cooling water from a cooling water nozzle in accordance with an uneven temperature distribution on a steel sheet in the rolling direction before and in the middle of cooling as described above, the shortest possible response time for the switch, and high-speed control are necessary since the transporting speed (almost same as the winding speed) of hot rolled steel sheets is as very fast as several to twenty-some meters per second.

For dissolving an uneven temperature distribution on a steel sheet in the sheet width direction before and in the middle of cooling, it is also necessary to switch between start and stop of spraying cooling water from each or each group of the cooling water nozzles arranged along the sheet width direction individually at a high speed. Since the above described response time of a conventional cooling device used in a cooling step of a hot rolled steel sheet is however approximately 1 second to 3 seconds, the hot rolled steel sheet is transported for ten to dozens of meters during the response time. Thus, it is especially impossible to sufficiently suppress expansion of an uneven temperature distribution after cooling on a steel sheet which varies by the pitch of approximately no more than 10 m in the rolling direction.

In the art disclosed in Patent Literature 1, the nozzles incorporating the open close valves that open and close by the pilot pressure are aligned in the sheet width direction. Then, a range to which a pilot pressure necessary for cutting off jets of the cooling water is applied is made to be selectable within an already disposed range in the sheet width direction, which makes it possible to selectively stop jets of the cooling water. This makes it possible to control cutting-on/off of jets of the cooling water correspondingly to a portion of lower temperatures such as edges and front and back ends of the steel sheet.

The response time for cutting-on/off jets of cooling water however depends on the moving speed of a piston rod. In the art disclosed in Patent Literature 1, the piston rod is moved by rotation of a screw, and thus the movement thereof is small, which makes it difficult to control cutting-on/off approximately no less than 3 times per 1 second. Therefore, there is a limit to dealing with an uneven temperature distribution of a short pitch (such as no more than 10 m).

In the art disclosed in Patent Literature 2, it is disclosed to change the direction of the flow of the cooling water cooling the steel tube, to realize a state where the steel tube is not cooled. A temperature at a certain point at a steel sheet in the sheet width direction however cannot be controlled only by the art of switching as described above.

In the art disclosed in Patent Literature 3, a cover is rotated so that the water flow for cooling does not impinge on an edge of a steel sheet. A temperature at a certain point at a steel sheet in the sheet width direction however cannot be controlled.

While it is disclosed to control the cooling medium quantity from the nozzles in the sheet width direction in the cooling device of Patent Literature 4, a concrete method for controlling the quantity is not disclosed therein. That is, while FIG. 8 of Patent Literature 4 illustrates the nozzles arranged in the sheet width direction, Patent Literature 4 does not disclose a way of controlling the cooling medium on the upstream side of piping connected to the nozzles. For example, when the piping connecting to the nozzles is not filled with the cooling medium, just controlling the cooling medium quantity results in low responsiveness when the cooling medium is applied from the nozzles. For switching between start and stop of spraying cooling water from a part of cooling water nozzles in accordance with an uneven temperature distribution on a steel sheet in the longitudinal direction before and in the middle of cooling as described above to control the quantity of cooling water that impinges on the steel sheet, the shortest possible response time and the realization of high-speed control thereof are necessary since the transporting speed of steel sheets is as very fast as several to twenty-some meters per second: the response time here is a time required for switching from the cooling water spraying to stop of the spraying, and for switching from the stop of spraying the cooling water to start of the spraying.

While disclosing controlling the cooling medium quantity in the sheet width direction, Patent Literature 4 does not disclose controlling the cooling medium in the rolling direction. In such a case, it is difficult to suppress a stripe of an uneven temperature distribution extending on the hot rolled steel sheet in the rolling direction. In addition, there exists water on the upper surface thereof, which makes it impossible to sufficiently control the temperature of the hot rolled steel sheet in the sheet width direction. In view of the above, a sufficient uniform temperature of the hot rolled steel sheet in the sheet width direction cannot be achieved by the cooling device of Patent Literature 4. The cooling device of Patent Literature 4 has a room for improvement.

The cooling device of Patent Literature 5 has the same problem as Patent Literature 4. That is, for example, when piping connecting to the nozzles is not always filled with the cooling water, responsiveness is low as well as described above since the on-off controlling valve controls the cooling water. Since only one cooling water header is provided in the rolling direction while a plurality thereof are provided in the sheet width direction, the temperature of the hot rolled steel sheet in the rolling direction cannot be controlled and it is difficult to suppress a stripe of an uneven temperature distribution.

In addition, while the cooling device of Patent Literature 5 sprays the cooling water over the upper surface of the hot rolled steel sheet to cool the steel sheet, there exists water on the upper surface thereof, which makes it impossible to sufficiently control the temperature of the hot rolled steel sheet in the sheet width direction. Further, the temperature cannot be correctly measured with the temperature distribution sensor unless this water is properly drained. There is a room for improving this temperature control.

In view of the above, it is difficult for conventional cooling devices and cooling methods to achieve uniform temperatures of hot rolled steel sheets in the rolling direction and the sheet width direction.

Cooling largely influences properties of materials of high tensile steel sheets. Since winding temperatures more largely influence properties of end products of high tensile steel sheets than those do conventional materials, an uneven temperature distribution that does not matter to conventional materials largely influences strength of high tensile steel sheets. Therefore, it is demanded to more accurately control cooling when high tensile steel sheets are manufactured than when conventional materials are manufactured. For example, there are the following problems in arts proposed so far which are to control a cooling temperature of a steel sheet by cooling water supplied from the upper surface side of the steel sheet:

(1) cooling water supplied from the upper surface side of a steel sheet impinges on, and then is left over the upper surface of the steel sheet, to be water over the sheet. The steel sheet is cooled not only at a point on which the cooling water impinges but also by the water over the sheet especially within an area where the temperature thereof is below 550° C. when the cooling water is supplied from the upper surface side. Since especially this influences high tensile steel sheets largely, an uneven temperature distribution is larger than on conventional materials;

(2) cooling water supplied from the upper surface side of a steel sheet impinges on the upper surface of the steel sheet, and then partially flows in the sheet width direction of the steel sheet. This water flowing in the sheet width direction interferes with the cooling water supplied from the upper surface side of the steel sheet. Therefore, it is difficult to accurately control the temperature of the steel sheet in the sheet width direction with the cooling water supplied from the upper surface side; and (3) for accurately controlling cooling temperature with cooling water supplied from the upper surface side of a steel sheet, it is necessary to remove water over the steel sheet using drainage. For easily improving the accuracy of temperature measurement, a thermometer is placed at a position where the thermometer is difficult to be influenced by the drainage, that is, at a position apart from a cooling water nozzle spraying the cooling water in the rolling direction. As a result, it takes a long time since the temperature is measured until the water impinges, and the temperature largely varies during this time, which deteriorates the accuracy of the control of the cooling temperature.

As described above, it is difficult to accurately control temperature in the sheet width direction according to conventional arts to control a cooling temperature of a steel sheet in the sheet width direction with cooling water supplied from the upper surface side of the steel sheet, to the extent of being demanded when high tensile steel sheets are manufactured.

The present invention was made in view of such viewpoints. An object of the present invention is to make the temperature of a hot rolled steel sheet more uniform in the rolling direction and the sheet width direction by properly cooling the undersurface of the hot rolled steel sheet after finish rolling in a hot rolling step.

Solution to Problem

A first aspect of the present invention is a cooling device cooling an undersurface of a hot rolled steel sheet that is being transported on transport rolls after finish rolling of a hot rolling step, the cooling device comprising: width divided cooling zones that are a plurality of cooling zones into which a whole cooling zone is divided in a sheet width direction, the whole cooling zone being a cooling zone partitioned by all of a width of an undersurface of a sheet transport zone in the sheet width direction and a predetermined length of the undersurface of the sheet transport zone in a rolling direction; divided cooling sections that are a plurality of cooling zones into which each of the width divided cooling zones is divided in the rolling direction; at least one cooling water nozzle spraying cooling water over each of undersurfaces of the divided cooling sections; a switching mechanism switching the cooling water sprayed from the cooling water nozzle between impinging and not impinging on the divided cooling sections; a width direction thermometer measuring a temperature distribution in the sheet width direction; and a controller controlling operation of the switching mechanism based on a result of measurement with the width direction thermometer.

Here, "impinging . . . on the divided cooling sections" in " . . . the cooling water sprayed from the cooling water nozzle between impinging and not impinging on the divided cooling sections" represents a jet of the cooling water such that the cooling water impinges on the undersurface of the hot rolled steel sheet when the undersurface of the hot rolled steel sheet is present on the divided cooling section. In contrast, "not impinging on the divided cooling sections" represents a state where the cooling water does not impinges on the undersurface of the hot rolled steel sheet when the undersurface of the hot rolled steel sheet is present on the divided cooling section.

In the cooling device according to the first aspect, said at least one cooling water nozzle may be arranged correspondingly to each of the divided cooling sections.

In the cooling device according to the first aspect, the number of the cooling water nozzles arranged for each of the divided cooling sections may be different between adjacent divided cooling sections in the rolling direction.

In the cooling device according to the first aspect, lengths of the divided cooling sections included in one of the width divided cooling zones may be different from each other in the rolling direction In the cooling device according to the first aspect, the lengths of the divided cooling sections in the rolling direction may be multiples of a length between the transport rolls.

In the cooling device according to the first aspect, a plurality of the cooling water nozzles in the sheet width direction may be arranged in such a way that center to center distances of adjacent cooling water nozzles in the sheet width direction are all equal.

In the cooling device according to the first aspect, a plurality of the cooling water nozzles for cooling each of the divided cooling sections can be arranged, and the switching mechanism can integratively control a switching control system switching the cooling water from the plurality of the cooling water nozzles between impinging and not impinging on each of the divided cooling sections at once.

In the cooling device according to the first aspect, the switching mechanism can be configured to comprise: a water supply header supplying the cooling water, the water supply header being provided for piping in which the cooling water supplied to the cooling water nozzles flows; a draining header or draining area draining the cooling water; and a valve switching a flow of the cooling water between the water supply header and the draining header or draining area.

At this time, the valve may be a three way valve, the valve may be provided on a side of the transport rolls in the sheet width direction, and the valve may be arranged at a same height as tops of the cooling water nozzles.

In the cooling device according to the first aspect, the switching mechanism may comprise: a water supply header supplying the cooling water, the water supply header being provided for piping in which the cooling water supplied to the cooling water nozzles flows; a draining area draining the cooling water; a means changing a direction of a jet of the cooling water that is sprayed from the cooling water nozzles; and a means such that the cooling water does not impinge on the divided cooling sections when the direction of the jet is changed, wherein the means changing the direction of the jet of the cooling water may make it possible to switch the cooling water between impinging and not impinging on the undersurfaces of the divided cooling sections.

In the cooling device according to the first aspect, the width direction thermometer can be provided on at least one of an upstream side and a downstream side of the whole cooling zone in the rolling direction, the width direction thermometer being provided for each of the width divided cooling zones. At this time, the width direction thermometer may be arranged on the side of the undersurface of the steel sheet transport zone.

A second aspect of the present invention is a method for cooling an undersurface of a hot rolled steel sheet that is being transported on transport rolls after finish rolling of a hot rolling step, the method comprising: defining a whole cooling zone as a cooling zone partitioned by all of a width of an undersurface of a sheet transport zone in a sheet width direction and a predetermined length of the undersurface of the sheet transport zone in a rolling direction, width divided cooling zones as a plurality of cooling zones into which the whole cooling zone is divided in the sheet width direction, and divided cooling sections as a plurality of cooling zones into which each of the width divided cooling zones is divided in the rolling direction; measuring a temperature distribution of the hot rolled steel sheet in the sheet width direction; and controlling the cooling water from cooling water nozzle impinging and not impinging on the hot rolled steel sheet for each of the divided cooling sections in each of the sheet width direction and the rolling direction based on a result of said measuring the temperature distribution.

In the second aspect, a plurality of the cooling water nozzles spraying the cooling water may be provided for each of the divided cooling sections, and the plurality of the cooling water nozzles may be integrated to control the cooling water from the plurality of the cooling water nozzles impinging and not impinging on part of the hot rolled steel sheet is controlled at once, the part being over each of the divided cooling sections.

In the second aspect, the method may further comprise: using a structure comprising: a water supply header supplying the cooling water, the water supply header being provided for piping in which the cooling water supplied to the cooling water nozzles flows, a draining header or draining area draining the cooling water, and a valve switching a flow of the cooling water between the water supply header and the draining header or draining area; and controlling open and close of the valve based on the result of said measuring the temperature distribution of the hot rolled steel sheet in the width direction, to control the cooling water from the cooling water nozzles impinging and not impinging on the hot rolled steel sheet for each of the divided cooling sections in each of the sheet width direction and the rolling direction.

Here, the valve is a three way valve supplying the cooling water to middle headers, the cooling water being supplied from the water supply header, for the middle headers each of the cooling water nozzles being provided, an opening degree of the three way valve provided for any of the middle headers that does not allow the cooling water from the cooling water nozzles to impinge on the undersurface of the hot rolled steel sheet may be controlled so that the cooling water from the cooling water nozzles continue to flow out to the extent of not impinging on the undersurface of the hot rolled steel sheet; and the opening degree of the three way valve provided for any of the middle headers that allows the cooling water from the cooling water nozzles to impinge on the undersurface of the hot rolled steel sheet may be controlled so that the cooling water from the cooling water nozzles impinges on the undersurface of the hot rolled steel sheet.

Advantageous Effects of Invention

According to the present invention, a temperature of a hot rolled steel sheet can be made to be more uniform in the rolling direction and the sheet width direction by properly cooling the undersurface of the hot rolled steel sheet after finish rolling in a hot rolling step.

DESCRIPTION OF EMBODIMENTS

Figure 1:
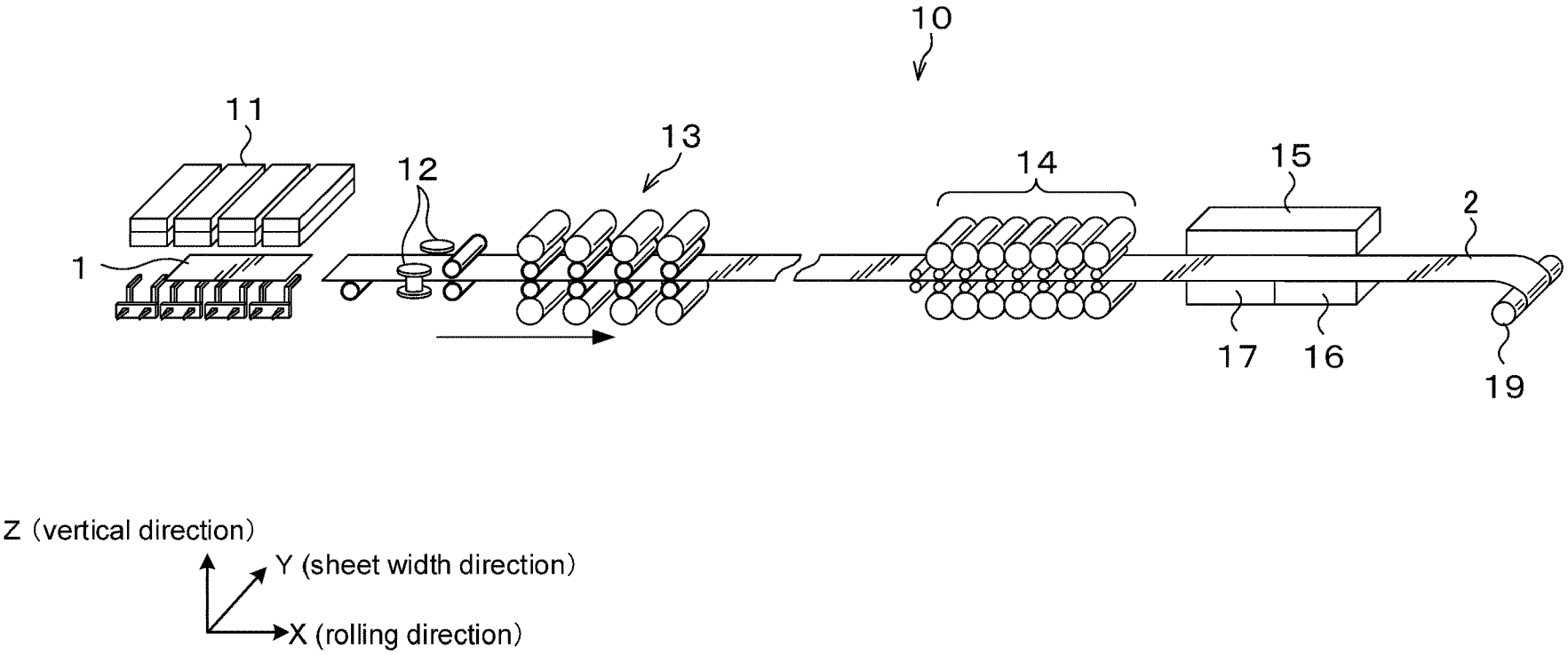
FIG. 1 is a schematically explanatory view of structure of a hot rolling system 10.

Embodiments of the present invention will be described hereinafter with reference to the drawings. In the present description and drawings, constitutional elements having substantially the same function and structure are denoted by the same reference numeral to omit redundant descriptions thereof.

First Embodiment

FIG. 1 is a schematically explanatory view of the structure of an apparatus for manufacturing hot rolled steel sheets including a cooling device (which will be hereinafter referred to as "hot rolling system") 10 in the first embodiment.

In the hot rolling system 10, a heated slab 1 is held by rolls from the top and bottom thereof, continuously rolled, thinned so as to have a thickness of at most approximately 1 mm, and wound as a hot rolled steel sheet 2. The hot rolling system 10 includes a heating furnace 11 for heating the slab 1, a width direction rolling mill 12 rolling the slab 1, which is heated in the heating furnace 11, in the sheet width direction, a rough rolling mill 13 rolling the slab 1, which is rolled in the sheet width direction, from above and beneath the slab 1 to make the slab 1 a rough bar, a finish rolling mill 14 continuously carrying out hot finish rolling further on the rough bar until the rough bar has a predetermined thickness, cooling devices 15, 16 and 17 cooling the hot rolled steel sheet 2, on which hot finish rolling is carried out by the finish rolling mill 14, with cooling water, and a winding device 19 winding the hot rolled steel sheet 2, which is cooled by the cooling devices 15, 16 and 17, like a coil. Among the cooling devices 15, 16 and 17, the upper side cooling device 15 is arranged above a steel sheet transport zone, and the lower side cooling device 16 and the lower side width direction control cooling device 17 are arranged beneath the steel sheet transport zone.

In the heating furnace 11, a process of heating the slab 1, which is transported from the outside via a charging inlet, to a predetermined temperature is performed. After the heating process in the heating furnace 11 is ended, the slab 1 is transported outside the heating furnace 11, passes through the width direction rolling mill 12, and thereafter moves into a rolling step by the rough rolling mill 13.

The transported slab 1 is rolled by the rough rolling mill 13 to be a rough bar (sheet bar) of a thickness up to approximately 30 mm to 60 mm, and transported to the finish rolling mill 14.

The finish rolling mill 14 rolls the transported rough bar so that the rough bar has a thickness of approximately several millimeters, to make the rough bar the hot rolled steel sheet 2. The rolled hot rolled steel sheet 2 is transported by transport rolls 18 (see FIGS. 2 to 4) to be moved to the upper side cooling device 15, the lower side cooling device 16, and the lower side width direction control cooling device 17.

The hot rolled steel sheet 2 is cooled by the upper side cooling device 15, the lower side cooling device 16 and the lower side width direction control cooling device 17, and wound by the winding device 19 like a coil.

A known cooling device may be employed as the upper side cooling device 15 without any limitation to its structure. For example, the upper side cooling device 15 has a plurality of cooling water nozzles spraying cooling water from above the steel sheet transport zone vertically downwards toward the upper surface of the steel sheet transport zone. For example, slit laminar nozzles or pipe laminar nozzles are used as the cooling water nozzles. The upper side cooling device 15 is preferably included in view of securing a cooling capacity, and is not necessarily arranged if there is no possibility of insufficient cooling. Generally, the upper side cooling device 15 is necessary.

The lower side cooling device 16 is a cooling device spraying cooling water from beneath the steel sheet transport zone where the steel sheet is transported on the transport rolls 18 of a run out table vertically upwards toward the undersurface of the steel sheet transport zone to cool the steel sheet transport zone. A known cooling device may be employed as the lower side cooling device 16 without any limitation to its structure.

Figure 2:
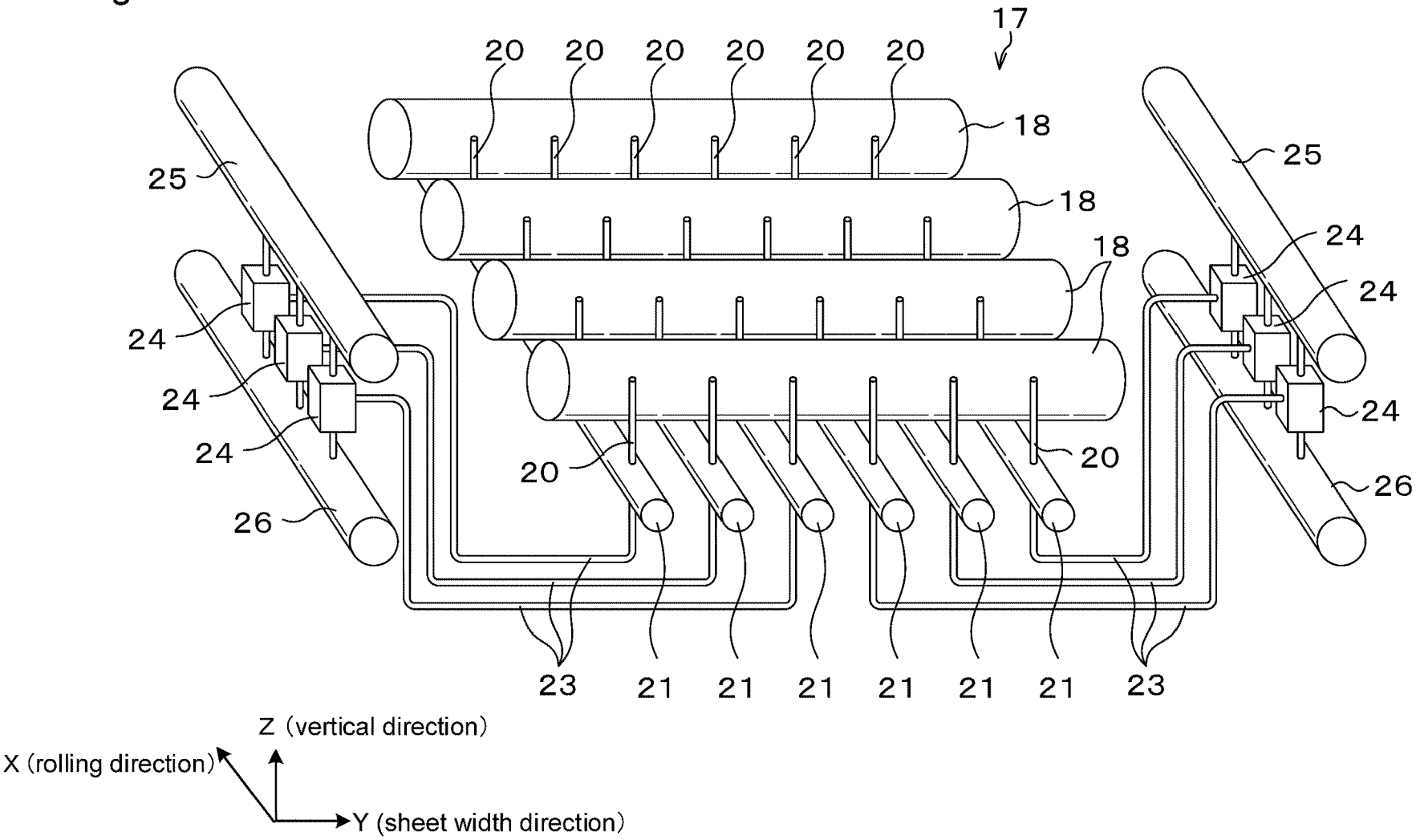
FIG. 2 is a schematically perspective view of structure of a lower side width direction control cooling device 17 according to the first embodiment.
Figure 3:
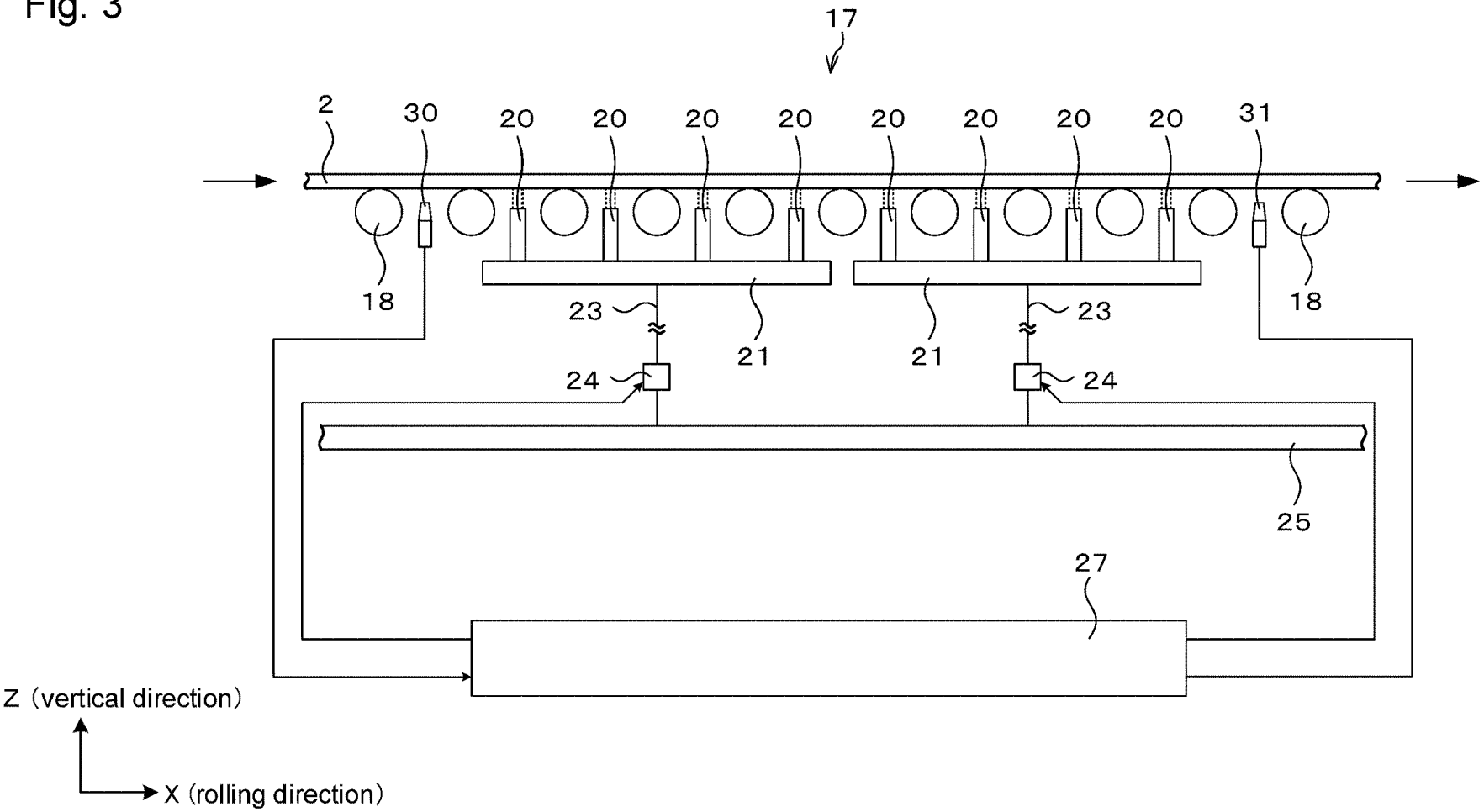
FIG. 3 is a schematically side view of the structure of the lower side width direction control cooling device 17 according to the first embodiment.
Figure 4:
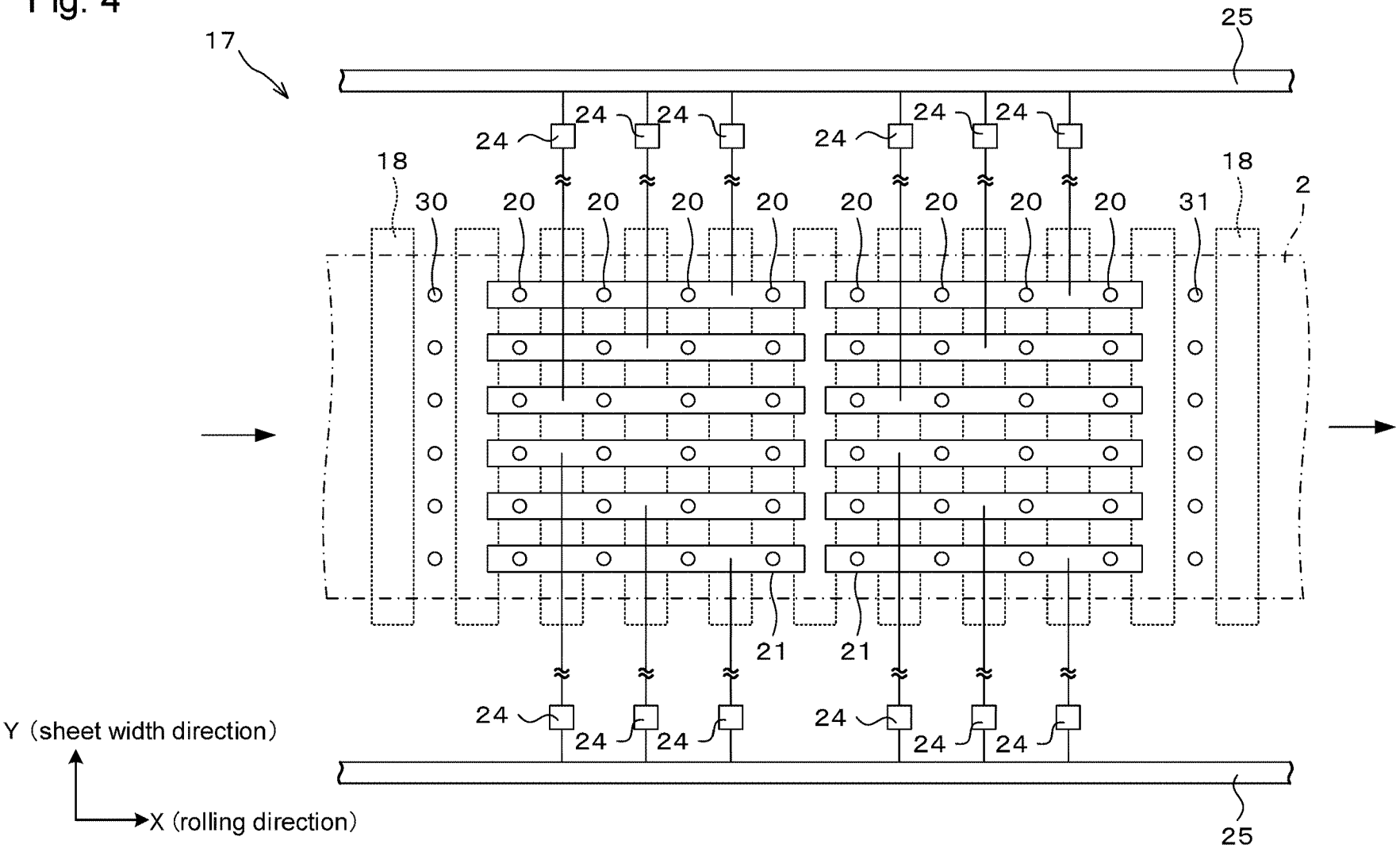
FIG. 4 is a schematically plan view of the structure of the lower side width direction control cooling device 17 according to the first embodiment.

The structure of the lower side width direction control cooling device 17 will be described next. FIG. 2 is a schematically perspective view of part of the structure of the lower side width direction control cooling device 17, FIG. 3 is a schematically side view of part of the structure of the lower side width direction control cooling device 17 in the sheet width direction (direction Y), and FIG. 4 is a schematically plan view of part of the structure of the lower side width direction control cooling device 17 in the vertical direction (direction Z).

The schematic structure of the lower side width direction control cooling device 17 in this embodiment includes cooling water nozzles 20, a switching mechanism provided with middle headers 21, piping 23, water supply headers 25, three way valves 24 and draining headers 26, temperature measurement devices 30 and 31, and a controller 27.

The lower side width direction control cooling device 17 is a device controlling cooling of divided cooling sections A3 formed by dividing a whole cooling zone A1 that is the undersurface of the steel sheet transport zone to be described later. FIGS. 5 to 8 are explanatory views thereof. FIGS. 5 to 8 are explanatory views of the divided cooling sections A3. FIGS. 5 to 8 illustrate the hot rolling system 10 viewed in the direction Z, to illustrate the relationship between the whole cooling zone A1 and positions of the transport rolls 18 to be described later. In FIGS. 5 to 8, the transport rolls 18 are denoted by dotted lines for an easy explanation.

In this embodiment, a zone where the hot rolled steel sheet 2 that the hot rolling system 10 may manufacture can be present when the hot rolled steel sheet 2 is transported on the run out table is defined as the "steel sheet transport zone". The "steel sheet transport zone" is, in short, a three-dimensional zone extending in the rolling direction which is partitioned by the maximum thickness and the maximum width of the hot rolled steel sheet that may be manufactured. Thus, the "steel sheet transport zone" occupies an area on the run out table after the end of the finish rolling mill on the downstream side before the winding device in the rolling direction.

On the undersurface of "steel sheet transport zone", a zone that the lower side width direction control cooling device 17 is to cool and is partitioned by a predetermined length in the rolling direction and all the width in the sheet width direction is defined as "whole cooling zone A1".

"All the width in the sheet width direction" indicates a zone where the hot rolled steel sheet 2 can be present on the transport rolls 18. "A predetermined length in the rolling direction" is at least no less than two pitches between rolls in the transport rolls 18 in the rolling direction. A length of "a pitch between rolls in the transport rolls 18 in the rolling direction" means a distance between the axes of adjacent transport rolls in the rolling direction. The length in "a predetermined length in the rolling direction" is not specifically restricted, and is preferably approximately no more than 20 m in view of operating costs for the system. A specific length thereof may be suitably determined in accordance with the cooling capacity of the lower side width direction control cooling device 17, and a predictable aspect of an uneven temperature distribution of the hot rolled steel sheet 2.

Figure 6:
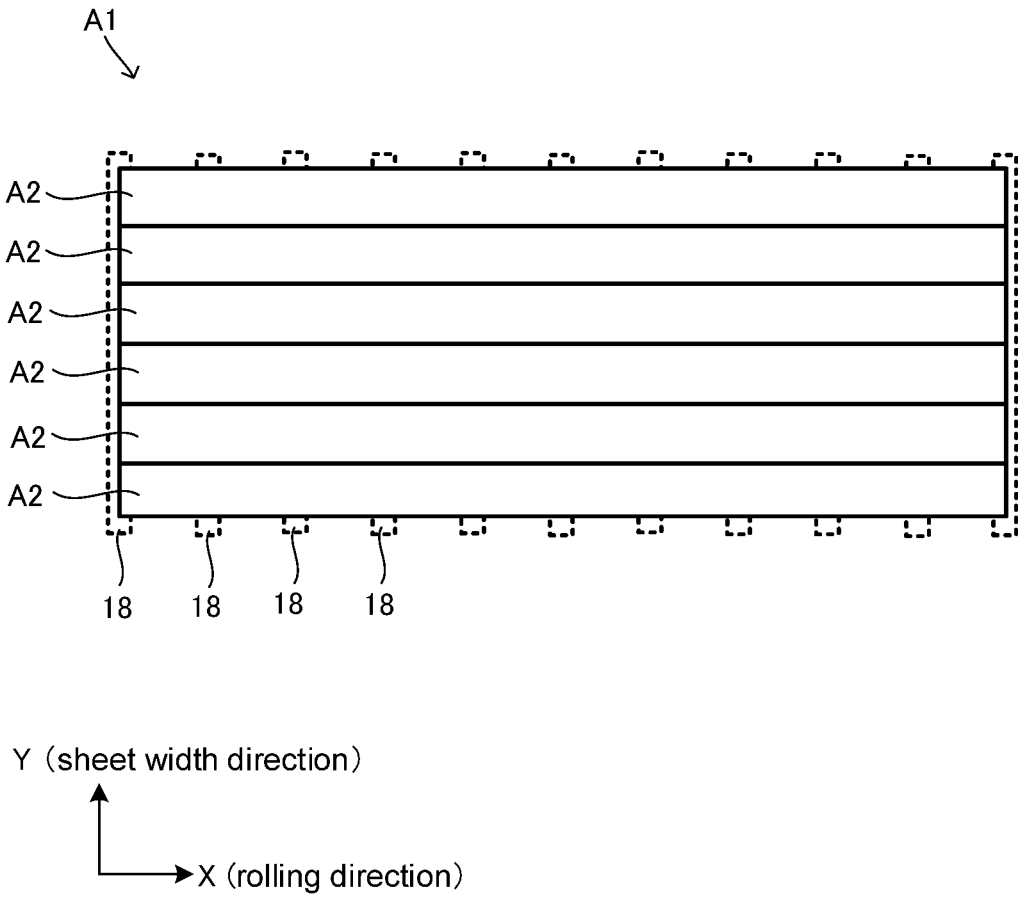
FIG. 6 is an explanatory view focusing on width divided cooling zones A2.

Each of cooling zones obtained by dividing the whole cooling zone A1 into plural zones in the sheet width direction is defined as a "width divided cooling zone A2". FIG. 6 illustrates one example of the steel sheet transport zone A1 divided into six width divided cooling zones A2. While six width divided cooling zones A2 are aligned in the sheet width direction in the example illustrated in FIG. 6 for easy understanding of the art, the number of the division is not limited thereto. The number of the width divided cooling zones A2 in the sheet width direction (that is, the number of the division) is not specifically limited.

The length of each width divided cooling zone A2 in the sheet width direction is a divided length of the steel sheet transport zone A1 in the sheet width direction by the number of the division. The length of each width divided cooling zone A2 in the sheet width direction is not specifically limited, and may be suitably set in 50 mm, 100 mm, or the like.

Each of cooling zones obtained by dividing each width divided cooling zone A2 into plural zones in the rolling direction is defined as a "divided cooling section A3". The length of each divided cooling section A3 in the sheet width direction is the same as that of each width divided cooling zone A2 in the sheet width direction. The length of each divided cooling section A3 in the rolling direction is a divided length of each width divided cooling zone A2 in the rolling direction by the number of the division.

Figure 5:
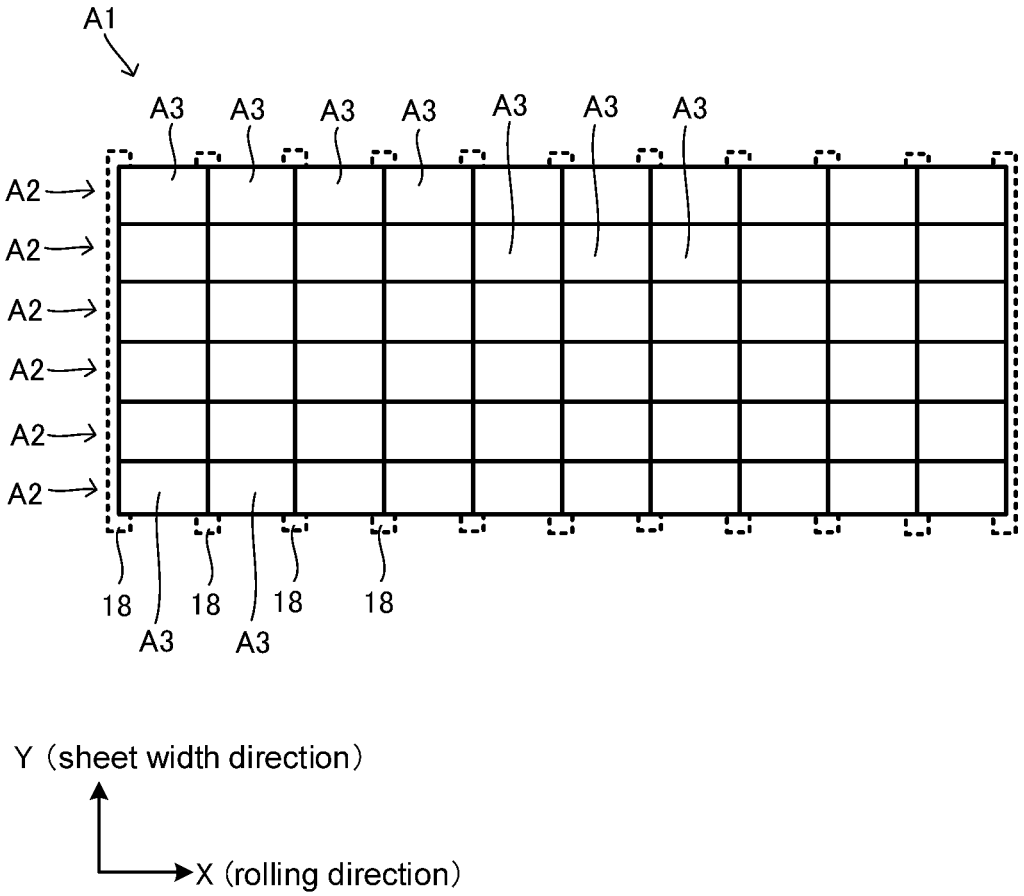
FIG. 5 is an explanatory view of one example of divided cooling sections A3.
Figure 7:
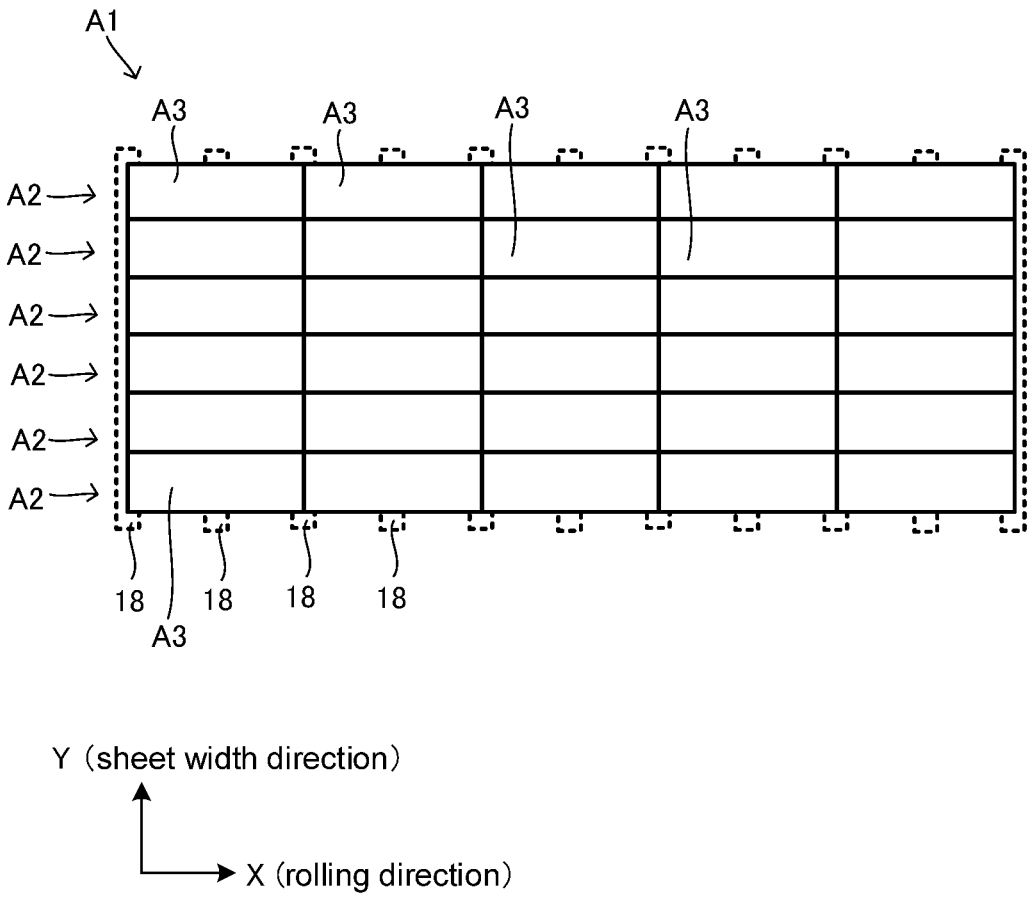
FIG. 7 is an explanatory view of another example of the divided cooling sections A3.

The length of each divided cooling section A3 in the rolling direction is not specifically limited, and may be suitably set. The length of each divided cooling section A3 in the rolling direction illustrated in FIG. 5 is set in the same as a pitch between rolls in the transport rolls 18 in the rolling direction. FIG. 7 illustrates an example of setting this length in two pitches between rolls in the transport rolls 18 in the rolling direction. As described above, the length of each divided cooling section A3 in the rolling direction may be a length of an integral multiple of a pitch between rolls in the transport rolls 18 in the rolling direction.

Figure 8:
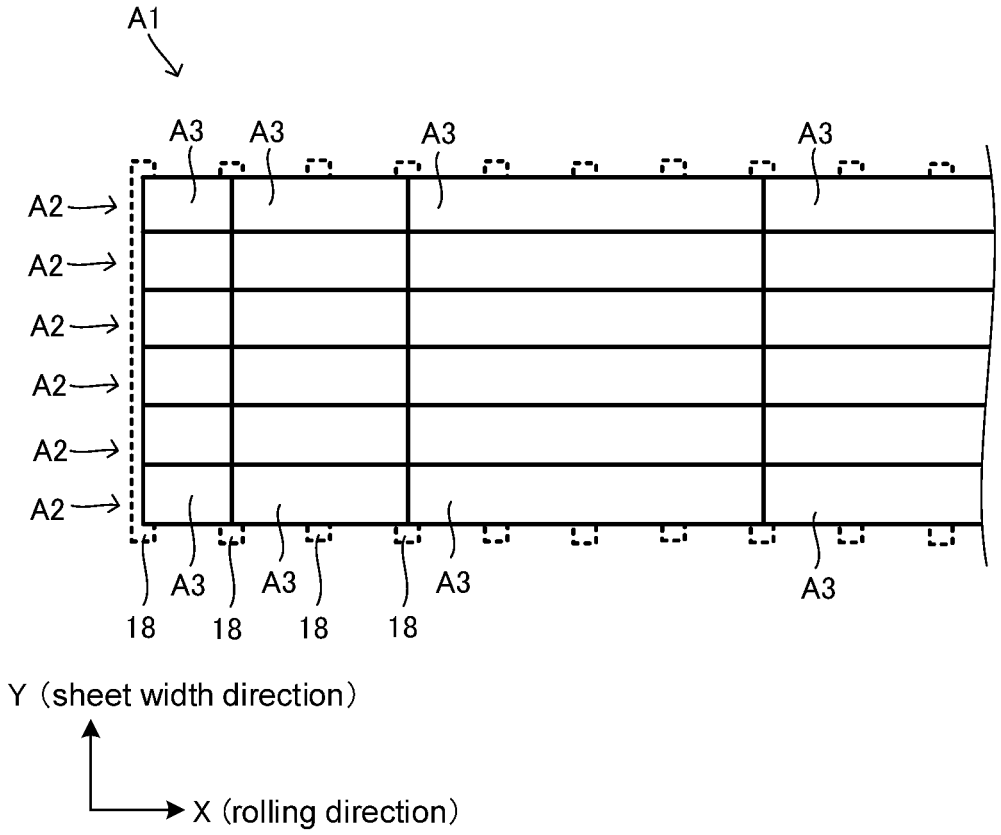
FIG. 8 is an explanatory view of still another example of the divided cooling sections A3.

The lengths of a plurality of the divided cooling sections A3 that are adjacently aligned in the rolling direction, in the rolling direction are not necessarily the same as, and may be different from each other. For example, as shown in FIG. 8, the lengths of the divided cooling sections A3 in the rolling direction may be longer in order from the upstream side to the downstream side as one, two, four, eight, sixteen . . . pitches between rolls in the transport rolls 18 in the rolling direction.

Figure 9:
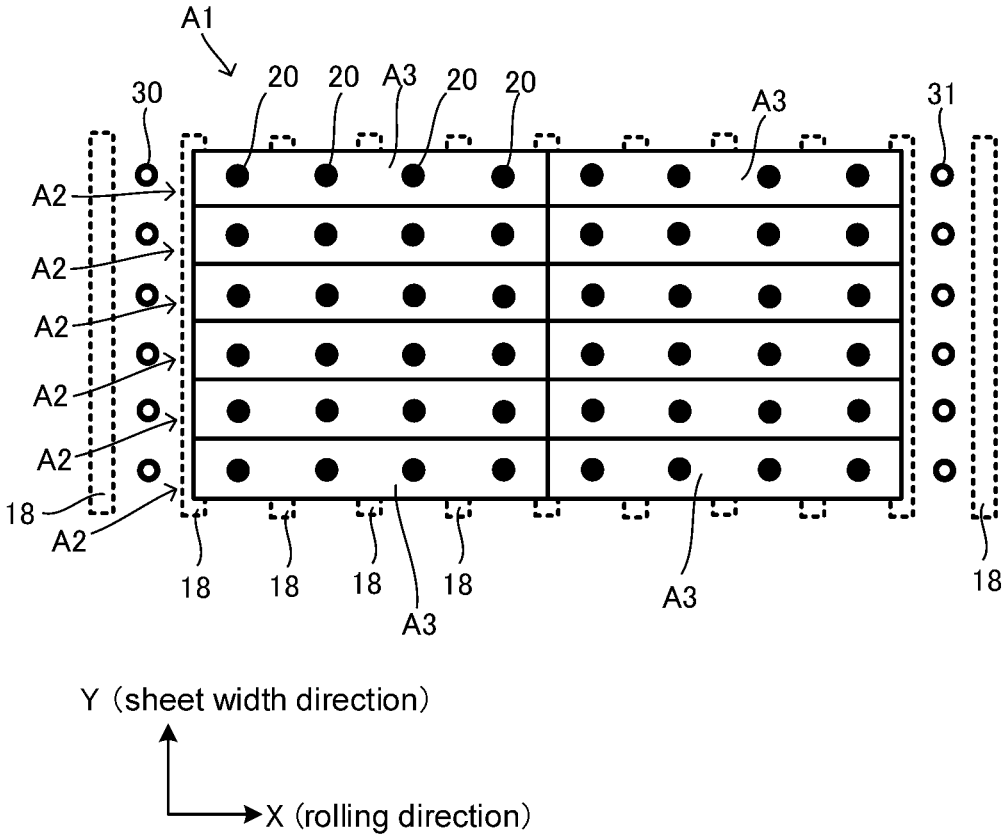
FIG. 9 is an explanatory view of the divided cooling sections A3, and arrangement of cooling water nozzles 20 and temperature measurement devices 30 and 31 in the lower side width direction control cooling device 17 according to the first embodiment.

Descriptions will be made with reference to an example of the divided cooling sections A3 each having a length in the rolling direction four times as long as a pitch between rolls in the transport rolls 18 in the rolling direction as shown in FIG. 9. In this embodiment, as shown in FIG. 9, each divided cooling section A3 has a length in the rolling direction four times as long as a pitch between rolls in the transport rolls 18 in the rolling direction. The divided cooling sections A3 of other embodiments as described above may be employed as well.

Arranged are a plurality of the cooling water nozzles 20, each of which is a cooling water nozzle spraying cooling water from beneath the steel sheet transport zone on the run out table vertically upwards toward the undersurface of the steel sheet transport zone. Nozzles of any known type may be used as the cooling water nozzles 20. Examples thereof include pipe laminar nozzles. A cooling range of each of the cooling water nozzles 20 in the sheet width direction shall have a length no more than the length of each divided cooling section A3 in the sheet width direction, so that an area that cooling water toward one divided cooling section A3 impinges on does not come into any other divided cooling sections A3.

FIG. 9 also illustrates the arrangement of the cooling water nozzles 20 for the divided cooling sections A3 in this embodiment. In FIG. 9, the cooling water nozzles 20 are denoted by black circles. At least one cooling water nozzle 20 is arranged for each of the divided cooling sections A3.

In this embodiment, the cooling water nozzles 20 are arranged so that four cooling water nozzles 20 are included in each divided cooling section A3 on the plan view of seeing the steel sheet transport zone from the top. In this embodiment, each of four cooling water nozzles 20 is arranged between adjacent transport rolls 18 and aligned in the rolling direction on the plan view. The number and arrangement of the cooling water nozzles 20 included in one divided cooling section A3 are not specifically limited. The number thereof may be one, and may be plural. The numbers and arrangement of the cooling water nozzles 20 may be different between adjacent divided cooling sections A3.

Control is easier if all the cooling water nozzles 20 in the sheet width direction and the rolling direction discharge water of the same quantity at the same flow rate so that their cooling capacities are the same. Control is also easier if the number, and the quantity and flow rate of discharged water of the cooling water nozzles 20 disposed on each divided cooling section A3 aligned in the sheet width direction which are at the same position in the rolling direction are the same so that the cooling capacities on the divided cooling sections A3 aligned in the sheet width direction are the same.

It is preferable to arrange the cooling water nozzles 20 included in each of the divided cooling sections A3 arranged in the sheet width direction and having the same quantity and flow rate of discharged water in such a way that the center to center distances of all the adjacent cooling water nozzles 20 in the sheet width direction are equal. Whereby uniform cooling in the sheet width direction can be more accurately carried out.

Even if the cooling capacities based on the quantities and flow rates of water discharged from the water cooling nozzles 20 are different between the sheet width direction and the rolling direction, the controller 27 can carry out control.

In this embodiment, two of the above described divided cooling sections A3 are aligned in the rolling direction (direction X), and six thereof are aligned in the sheet width direction (direction Y). The cooling water nozzles 20 having the same quantity and flow rate of discharged water are also aligned in each of the rolling direction and the sheet width direction.

FIG. 9 illustrates the divided cooling sections A3 in this embodiment and the arrangement of the cooling water nozzles 20 that are included in these divided cooling sections A3, which does not limit the present invention, and any combination may be employed. FIGS. 10 to 13 exemplarily illustrate such combination. The cooling water nozzles here are set so as to have the same quantity and flow rate of discharged water, to have the same cooling capacity.

Figure 10:
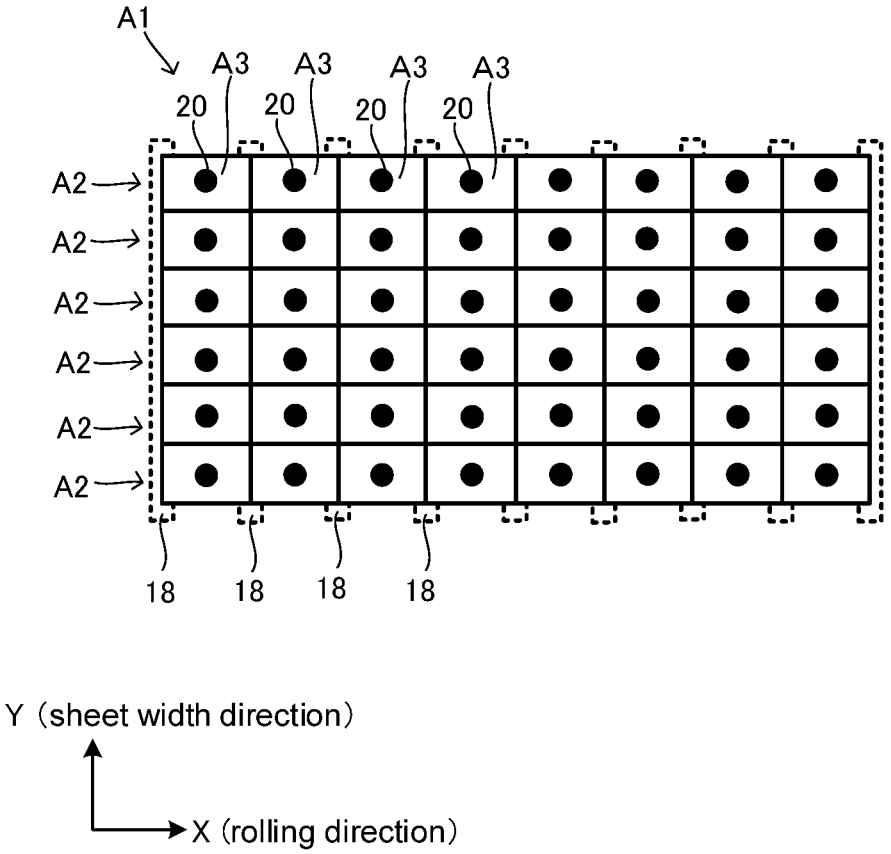
FIG. 10 illustrates an example of the divided cooling sections A3 and the arrangement of the cooling water nozzles 20.

In the example illustrated in FIG. 10, the length of each divided cooling section A3 in the rolling direction is a pitch between rolls in the transport rolls 18 in the rolling direction. One cooling water nozzle 20 is included in each divided cooling section A3.

Figure 11:
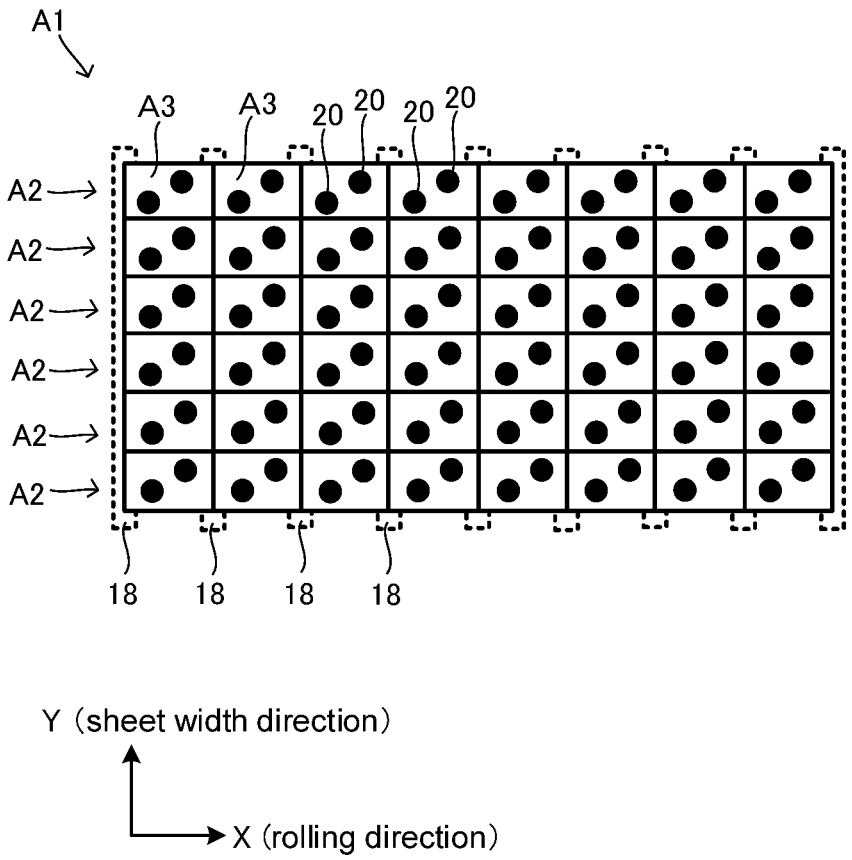
FIG. 11 illustrates another example of the divided cooling sections A3 and the arrangement of the cooling water nozzles 20.

In the example illustrated in FIG. 11, the length of each divided cooling section A3 in the rolling direction is a pitch between rolls in the transport rolls 18 in the rolling direction. Two cooling water nozzles 20 are arranged on each divided cooling section A3. These two cooling water nozzles 20 may be aligned in the rolling direction, may be aligned in the sheet width direction, and, as shown in FIG. 11, may be arranged so as to be shifted from each other in both the rolling direction and the sheet width direction.

Figure 12:
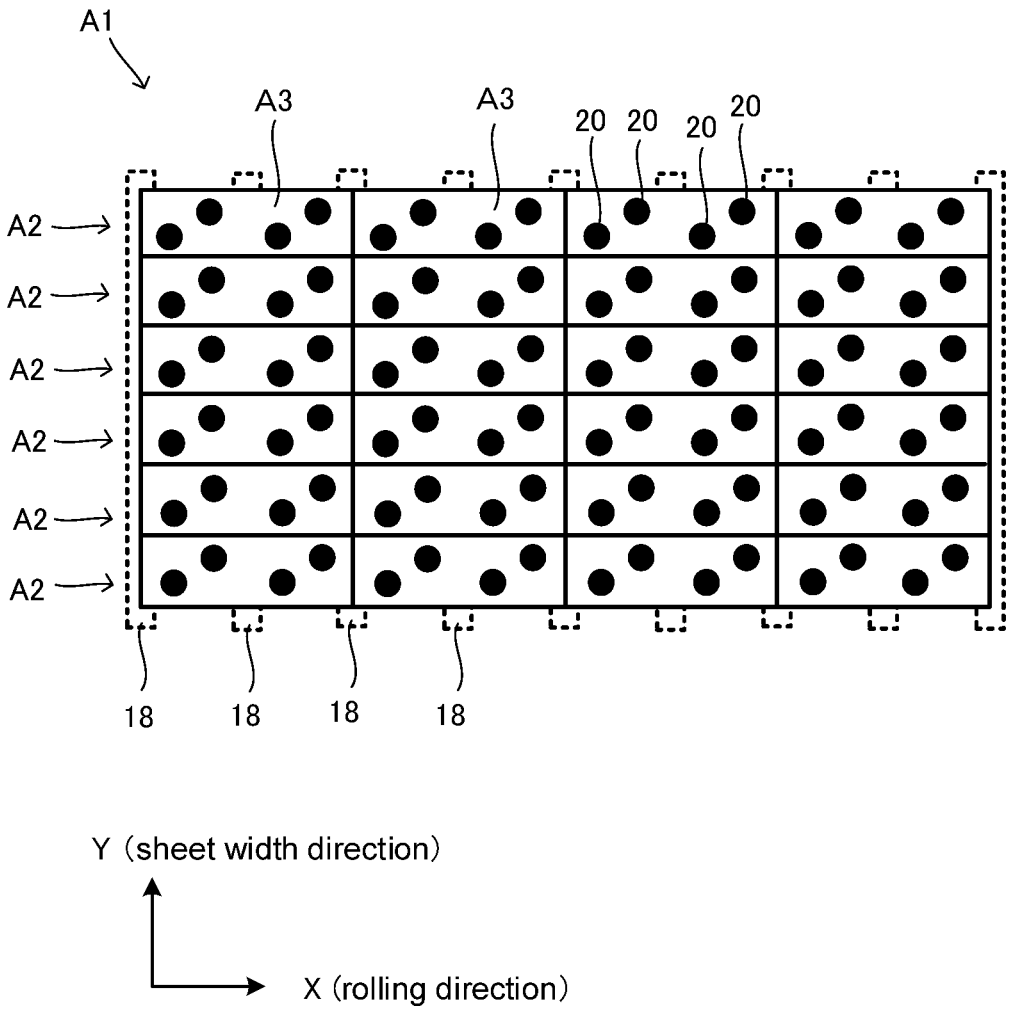
FIG. 12 illustrates still another example of the divided cooling sections A3 and the arrangement of the cooling water nozzles 20.

In the example illustrated in FIG. 12, the length of each divided cooling section A3 in the rolling direction is two pitches between rolls in the transport rolls 18 in the rolling direction. Four cooling water nozzles 20 are arranged on each divided cooling section A3.

Figure 13:
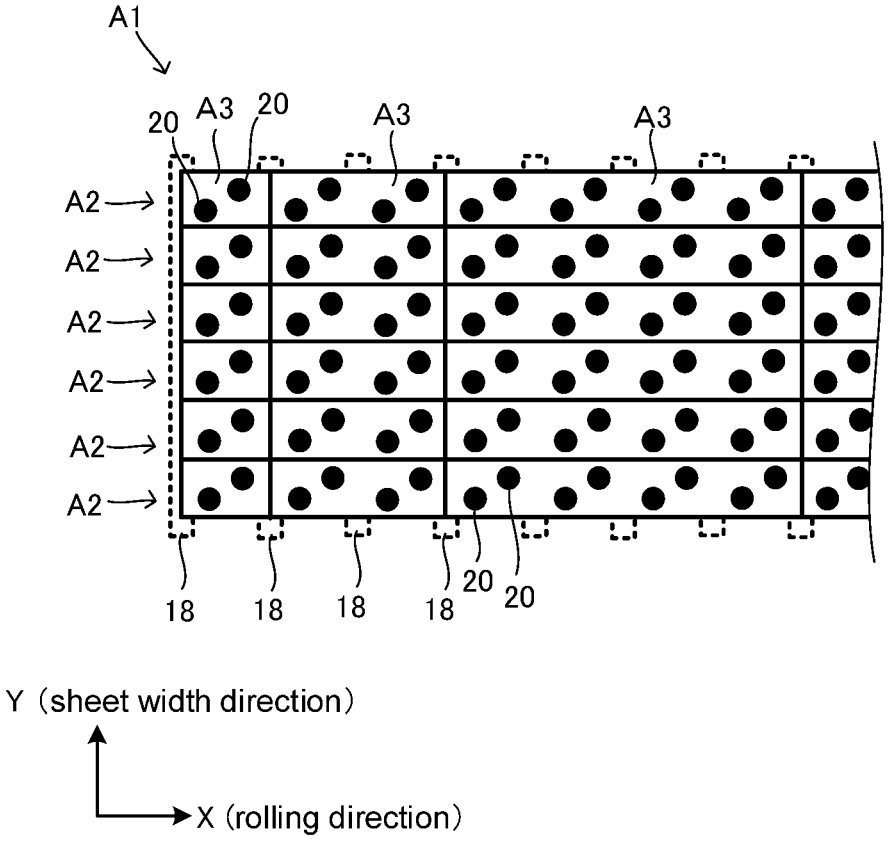
FIG. 13 illustrates yet another example of the divided cooling sections A3 and the arrangement of the cooling water nozzles 20.

In the example illustrated in FIG. 13, the lengths of the divided cooling sections A3 in the rolling direction are different in order from the upstream side as one, two, four, eight . . . pitches between rolls in the transport rolls 18 in the rolling direction, and the numbers of the cooling water nozzles 20 included in the respective divided cooling sections A3 are different between adjacent divided cooling sections A3 in the rolling direction.

The middle headers 21 function as part of the switching mechanism in this embodiment. The middle headers 21 are headers supplying cooling water to the cooling water nozzles 20. In this embodiment, as seen in FIGS. 2 to 4, each of the middle headers 21 is a tubular member extending in the rolling direction, and a plurality of the cooling water nozzles 20 are disposed therein in the rolling direction. Thus, spraying of cooling water from the cooling water nozzles 20 disposed in one middle header 21, and stop of the spraying can be controlled at once. In the illustrated example, four cooling water nozzles 20 are aligned for each middle header 21 in the rolling direction. The number of the cooling water nozzles 20 is not restricted thereto.

The middle headers 21 are arranged so that each divided cooling section A3 includes one middle header 21, whereby switch between spraying of cooling water and stop of the spraying can be controlled for each divided cooling section A3.

In this embodiment, since two divided cooling sections A3 are provided in the rolling direction, only two middle headers 21 are provided in the rolling direction as well. The number of the middle headers 21 may be suitably changed in accordance with the number of the divided cooling sections A3.

The three way valves 24 are members functioning as part of the switching mechanism in this embodiment. That is, the three way valves 24 are primary members of the switching mechanism switching cooling water sprayed from the cooling water nozzles 20 between impinging and not impinging on the undersurface of the steel sheet transport zone.

The three way valves 24 in this embodiment are bypass-types. The three way valves 24 are valves switching water from the water supply headers 25 between being guided into the piping 23 to be supplied to the middle headers 21 and further to the cooling water nozzles 20, and being guided into the draining headers 26. In this embodiment, the draining headers 26 are illustrated as an example of parts for draining. The aspect thereof is not specifically restricted.

Instead of the three way valves 24 in this embodiment, one may dispose two stop valves (valves for stopping the flow of fluid in a broad sense, which may be also referred to as ON/OFF valves) to perform control in the same manner as the three way valves.

In this embodiment, one three way valve 24 is disposed for each middle header 21, and the three way valves 24 are arranged between the water supply headers 25 supplying cooling water and the draining headers 26 draining cooling water, which does not limit the present invention. One three way valve 24 may be arranged for each plurality of the middle headers 21. According to this, a plurality of the middle headers 21 can be integratively controlled at once.

In the illustrated example, two water supply headers 25 and two draining headers 26 are provided. The numbers of these water supply headers 25 and draining headers 26 are not limited thereto, and for example, may be one respectively.

The inside of the piping 23 is always filled with cooling water by the three way valves 24, which makes it possible to shorten a time since an order to open any three way valve 24 is outputted until cooling water is sprayed from the corresponding cooling water nozzles 20, to improve responsiveness when the cooling water impinges on the undersurface of the steel sheet transport zone (divided cooling section A3), that is, when the undersurface of the hot rolled steel sheet 2 is cooled. The responsiveness of open and close of the three way valves 24 is preferably within 0.5 seconds. For example, solenoid valves are used for the three way valves 24.

The three way valves 24 are preferably arranged at the same height as the tops of the cooling water nozzles 20. More specifically, portions of the three way valves 24 which are connected to the piping 23 are preferably at the same height as the tops of the cooling water nozzles 20. Whereby, the tops of the cooling water nozzles 20 and the ends of the piping 23 have the same height, and thus the inside of the piping 23 is always filled with cooling water. For example, even if the three way valves 24 are not perfectly sealed so that a little cooling water leaks, the inside of the piping 23 can be filled with the cooling water, which makes it possible to further improve responsiveness.

The three way valves 24 are preferably provided on the sides of the transport rolls 18 in the sheet width direction. It can be, for example, considered that the three way valves 24 are provided beneath the transport rolls 18. However, a space beneath the transport rolls 18 is limited, so that it is difficult to provide a plurality of the three way valves 24 therein. It is also difficult to do maintenance for the three way valves 24 beneath the transport rolls 18. In these points, if the three way valves 24 are provided on the sides of the transport rolls 18 in the sheet width direction as this embodiment, the three way valves 24 are highly flexibly disposed and maintenance therefor can be easily done.

The upstream side temperature measurement devices 30 are arranged at positions at the steel sheet transport zone on the undersurface side thereof, function as width direction thermometers, and measure the temperature of the hot rolled steel sheet 2 on the whole cooling zone A1 on the upstream side in the rolling direction.

The upstream side temperature measurement devices 30 are preferably arranged correspondingly to respective width divided cooling zones A2. Thus, in the illustrated example, six upstream side temperature measurement devices 30 are aligned to be disposed in the sheet width direction so as to be able to measure the temperatures of the respective width divided cooling zones A2 on the upstream side (in short, temperatures before cooled). Whereby, the temperature of the hot rolled steel sheet 2 on the upstream side of the lower side width direction control cooling device 17 can be measured in all over the sheet width direction.

The downstream side temperature measurement devices 31 are arranged at positions at the steel sheet transport zone on the undersurface side thereof, function as width direction thermometers, and measure the temperature of the hot rolled steel sheet 2 on the whole cooling zone A1 on the downstream side in the rolling direction.

The downstream side temperature measurement devices 31 are preferably arranged correspondingly to the width divided cooling zones A2. In the illustrated example, six downstream side temperature measurement devices 31 are aligned to be disposed in the sheet width direction so as to be able to measure the temperatures of the respective width divided cooling zones A2 after cooled. Whereby, the temperature of the hot rolled steel sheet 2 on the downstream side of the lower side width direction control cooling device 17 in the rolling direction can be measured in all over the sheet width direction.

The controller 27 is a device controlling the operation of the switching mechanism based on measurement results of one or both of the upstream side temperature measurement devices 30 and the downstream side temperature measurement devices 31. Thus, the controller 27 includes an electronic circuit and a computer which operate calculations based on a predetermined program. The upstream side temperature measurement devices 30, the downstream side temperature measurement devices 31, and the switching mechanism are electrically connected to the controller 27.

Specifically, the upstream side temperature measurement devices 30 measure the temperature of the hot rolled steel sheet 2 transported on the run out table after finish rolling. The results of this measurement are sent to the controller 27, and a cooling capacity necessary for making the temperature of the hot rolled steel sheet 2 uniform is calculated for each divided cooling section A3.

Based on the results of this calculation, the controller 27 carries out feed forward control on open and close of the three way valves 24. That is, the controller 27 controls open and close of the three way valves 24 to control cooling water sprayed from the cooling water nozzles 20 impinging and not impinging on the undersurface of the hot rolled steel sheet 2 for each divided cooling section A3 for realizing the cooling capacity of each divided cooling section A3 such that the temperature of the hot rolled steel sheet 2 is made to be uniform.

Since the divided cooling sections A3 are aligned in both of the sheet width direction and the rolling direction, the controller 27 can control temperature in both the sheet width direction and the rolling direction, so as to be able to accurately make the temperature of the hot rolled steel sheet 2 uniform.

Feed forward control is also effective for suppressing a stripe of an uneven temperature distribution extending on the hot rolled steel sheet 2 in the rolling direction. In view of this, feed forward control with the upstream side temperature measurement devices 30 can lead to a further uniform temperature of the hot rolled steel sheet 2 in the sheet width direction.

Not only feed forward control but also feed back control based on the results of measurement of the downstream side temperature measurement devices 31 may be carried out on open and close of the three way valves 24. That is, the controller 27 operates calculations using the results of measurement of the downstream side temperature measurement devices 31, and based on the results of the calculations, the numbers of three way valves 24 opened and closed are controlled for each divided cooling section A3. Whereby, it can be controlled to impinge and not to impinge on the undersurface of the steel sheet transport zone with cooling water for each divided cooling section A3.

In the lower side width direction control cooling device 17, feed forward control on the three way valves 24 based on the results of measurement of the upstream side temperature measurement devices 30 and feedback control on the three way valves 24 based on the results of measurement of the downstream side temperature measurement devices 31 can be selectively carried out.

Such feedback control can be also employed as correction control for the results of feed forward control. As described above, in the lower side width direction control cooling device 17, feed forward control on the three way valves 24 based on the results of measurement of the upstream side temperature measurement devices 30 and feedback control on the three way valves 24 based on the results of measurement of the downstream side temperature measurement devices 31 can be integratively carried out.

When only one of feed forward control and feedback control is carried out, either of the upstream side temperature measurement devices 30 and the downstream side temperature measurement devices 31 may be omitted.

In the lower side width direction control cooling device 17, since the three way valves 24 are provided for the middle headers 21 and further, arranged at the same height as the tops of the cooling water nozzles 20, the inside of the piping 23 can be always filled with cooling water. Therefore, when open and close of the three way valves 24 are controlled based on the results of temperature measurement of the upstream side temperature measurement devices 30 and/or the downstream side temperature measurement devices 31 to control cooling water sprayed from the cooling water nozzles 20, responsiveness thereof can be extremely improved.

In order to fill the inside of the piping 23 with cooling water more certainly, the cooling water may always continue to flow out of the cooling water nozzles 20. That is, the opening degree of the three way valve 24 provided for the middle header 21 that does not allow cooling water from the cooling water nozzle 20 to impinge on the divided cooling section A3 is controlled so that the cooling water from the cooling water nozzle 20 continues to flow out to the extent of not impinging on the divided cooling section A3. In contrast, the opening degree of the three way valve 24 provided for the middle header 21 that allows cooling water from the cooling water nozzle 20 to impinge on the divided cooling section A3 is controlled so that the cooling water from the cooling water nozzle 20 impinges on the divided cooling section A3. In such a case, the responsiveness can be secured since the inside of the piping 23 is certainly filled with cooling water.

Figure 14:
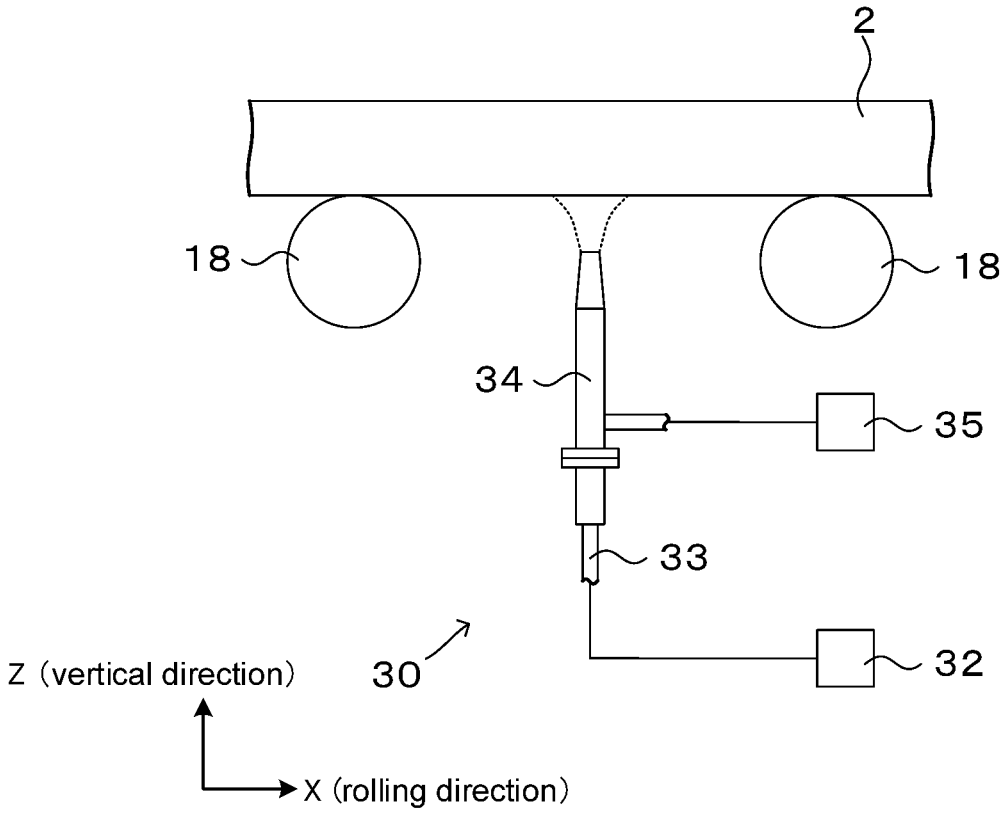
FIG. 14 is an explanatory view illustrating an example of an embodiment of the temperature measurement device 30.

The structures of the upstream side temperature measurement devices 30 and the downstream side temperature measurement devices 31 in the lower side width direction control cooling device 17 of this embodiment are not specifically restricted as long as these devices measure the temperature of the hot rolled steel sheet 2. For example, temperature measurement devices described in JP 3818501 B2 etc. are preferably used as the temperature measurement devices 30 and 31. FIG. 14 is a schematically explanatory view of the structure of one of the upstream side temperature measurement devices 30.

Each of the upstream side temperature measurement devices 30 includes a radiation thermometer 32 measuring the temperature of the hot rolled steel sheet 2, an optical fiber 33 whose top is arranged at a position facing the steel sheet transport zone (hot rolled steel sheet 2) and whose bottom is connected to the radiation thermometer 32, a nozzle 34 as a water column forming part spraying water over the undersurface of the steel sheet transport zone so as to form a water column between the steel sheet transport zone and the top of the optical fiber 33, and a water tank 35 for supplying water to the nozzle 34. The radiation thermometer 32 receives synchrotron radiation from the undersurface of the steel sheet transport zone (hot rolled steel sheet 2) via this water column, so that the upstream side temperature measurement device 30 measures the temperature of the undersurface of the hot rolled steel sheet 2.

Here, some measurement errors caused by cooling water from the cooling water nozzles 20 or the like which is generally present over the undersurface of the steel sheet transport zone occur when a normal thermometer is used. Therefore, a section where no cooling water is present in the rolling direction because cooling water is drained (for example, several meters) is necessary for disposing a thermometer.

For this, since the radiation thermometer 32 receives synchrotron radiation via the water column from the nozzle 34 in the upstream side temperature measurement device 30, this water column suppresses the influence of cooling water, which makes it possible to reduce measurement errors caused by cooling water. Thus, there is no necessity for providing a section where no cooling water is present, and it is possible to arrange the upstream side temperature measurement devices 30 in close vicinity to the cooling water nozzles 20 on the most upstream side, which makes it possible to further improve responsiveness. For securing sufficient responsiveness, the distance between the upstream side temperature measurement devices 30 and the cooling water nozzles 20 on the most upstream side is preferably within 5 m, and further preferably within 1 m.

Since the hot rolled steel sheet 2 snakes the run out table, positions where temperature is measured may be different from cooling positions on the hot rolled steel sheet 2 in the sheet width direction if the distance between the upstream side temperature measurement devices 30 and the cooling water nozzles 20 at the most upstream side is long. In such a case, especially the edges of the hot rolled steel sheet 2 in the sheet width direction and their vicinity might not be cooled.

For this as well, since it is possible to arrange the upstream side temperature measurement devices 30 in close vicinity to the cooling water nozzles 20 on the most upstream side in this embodiment, positions where temperature is measured can be surely made to be the same as cooling positions at the hot rolled steel sheet 2 in the sheet width direction, which makes it possible to properly cool the hot rolled steel sheet 2.

The structures of the downstream side temperature measurement devices 31 are the same as the upstream side temperature measurement devices 30, and the effect same as above described for the upstream side temperature measurement devices 30 can be also obtained from the downstream side temperature measurement devices 31.

The three way valves 24 are provided for the middle headers 21. The smaller the number of the cooling water nozzles 20 for each middle header 21 is, the more controllability on cooling water sprayed over the hot rolled steel sheet 2 is improved. In contrast, the number of the necessary three way valves 24 relatively increases as the number of the cooling water nozzles 20 is decreased, which makes operating costs for the system and running costs high. Thus, the number of the cooling water nozzles 20 may be set in view of balance thereof.

Using a small quantity of cooling water for impinging on the divided cooling sections A3 requires a long whole cooling zone A1 in the rolling direction. Thus, for example, cooling water of a high flow density of no less than 1 $m^3/m^2/min$ is preferably sprayed from every cooling water nozzle 20.

Figure 15:
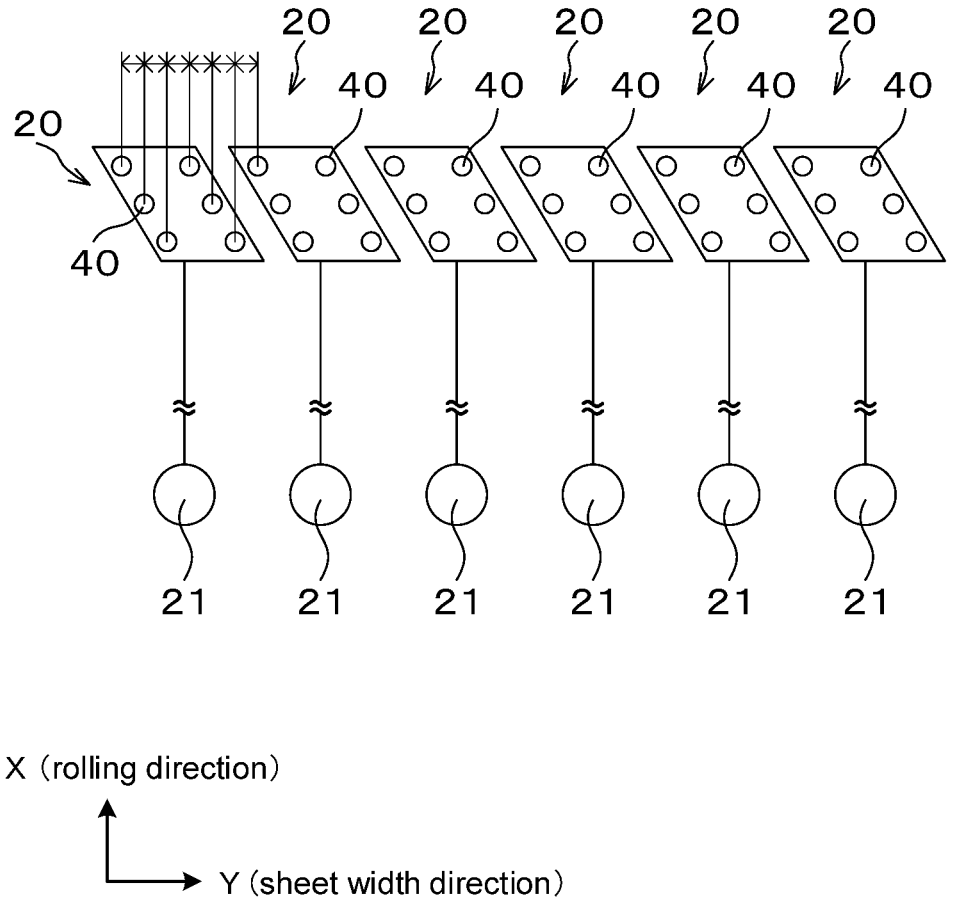
FIG. 15 is an explanatory view illustrating an example of an embodiment of the cooling water nozzle 20.

In the lower side width direction control cooling device 17, a plurality of jet holes 40 via which cooling water is sprayed may be provided for the top of each cooling water nozzle 20 as shown in FIG. 15. A plurality of the jet holes 40 are provided at regular intervals in a projected face in the sheet width direction (direction Y). For example, when cooling water of a large quantity is sprayed via a single jet hole of the cooling water nozzle 20, the cooling water impinges on one point at the hot rolled steel sheet 2 in the sheet width direction, which easily causes a stripe of an uneven temperature distribution. In contrast, providing a plurality of the jet holes 40 makes it possible to lower pressure of jets of cooling water on the divided cooling sections A3. Therefore, a stripe of an uneven temperature distribution can be more certainly suppressed, and the temperature of the hot rolled steel sheet 2 in the sheet width direction can be made to be further uniform.

Figure 16:
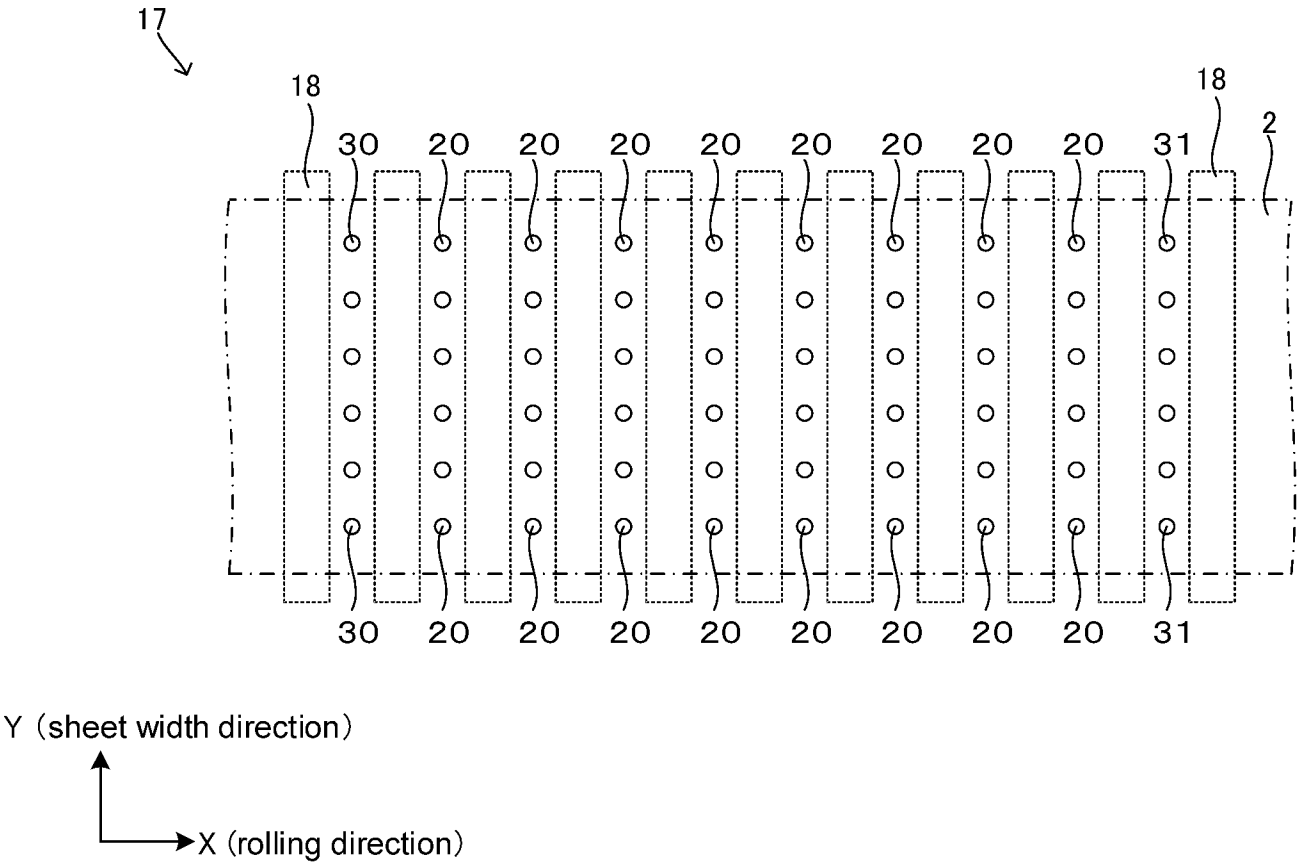
FIG. 16 is an explanatory view illustrating an example of the structure of the lower side width direction control cooling device 17 having no middle header 21.

The middle headers 21 are included in this embodiment. The present invention is however not limited to this embodiment, and an embodiment of including no middle header 21 may be encompassed therein. FIG. 16 is a plan view schematically illustrating the structure of the lower side width direction control cooling device 17 according to such an embodiment. FIG. 16 corresponds to FIG. 4, and thus actually one three way valve 24 is connected to each cooling water nozzle 20 therein. In FIG. 16, the three way valves 24, the water supply headers 25 and the draining headers 26 are omitted for easy understanding.

In the embodiment illustrated in FIG. 16, a branch of piping not shown is connected to each cooling water nozzle 20. The three way valves are provided for these respective branches of the piping. The three way valves are provided between the water supply headers supplying cooling water to the piping and the draining headers draining cooling water. The effect same as that obtained in the above described embodiment can be obtained from the embodiment of providing one three way valve for each cooling water nozzle 20 as described just above as well. The definition of the divided cooling sections A3 in this case is the same as that in the lower side width direction control cooling device 17 shown in FIG. 4.

The lower side width direction control cooling device 17 in the example illustrated in FIG. 1 is arranged on the upstream side of the lower side cooling device 16. A place to arrange the lower side width direction control cooling device 17 is not restricted to this example.

Arranging the lower side width direction control cooling device 17 on the upstream side of the lower side cooling device 16 as the example illustrated in FIG. 1 makes it possible to remove an uneven temperature distribution appearing on the hot rolled steel sheet 2 at the initial stage of a cooling step.

In contrast, arranging the lower side width direction control cooling device 17 in the middle of the lower side cooling device 16 makes it possible to remove an uneven temperature distribution caused by ununiform cooling by the upper side cooling device 15 and the lower side cooling device 16.

Arranging the lower side width direction control cooling device 17 on the downstream side of the lower side cooling device 16 makes it possible to reduce an uneven temperature distribution of the winding temperature.

As described above, since effect varies in accordance with a place to arrange the lower side width direction control cooling device 17 with respect to the lower side cooling device 16, this place may be suitably determined in view of a steel type to be manufactured and operating costs for the system. In view of suppressing an uneven temperature distribution as much as possible, the lower side width direction control cooling device 17 is preferably arranged each on the upstream side, in the middle, and on the downstream side of the lower side cooling device 16.

Second Embodiment

In the second embodiment, cooling water moving direction changing devices 126, 226 or 326, and guide plates 125 are arranged instead of the three way valves 24 in the switching mechanism in the first embodiment in a lower side width direction control cooling device 117 arranged instead of the lower side width direction control cooling device 17 in the hot rolling system 10, and a drainage area is provided but no draining header is provided. Since the same structures as in the first embodiment may be employed for the other structures, the same structures as in the first embodiment are denoted by the same reference numerals as in the first embodiment, and descriptions thereof are omitted.

Figure 17:
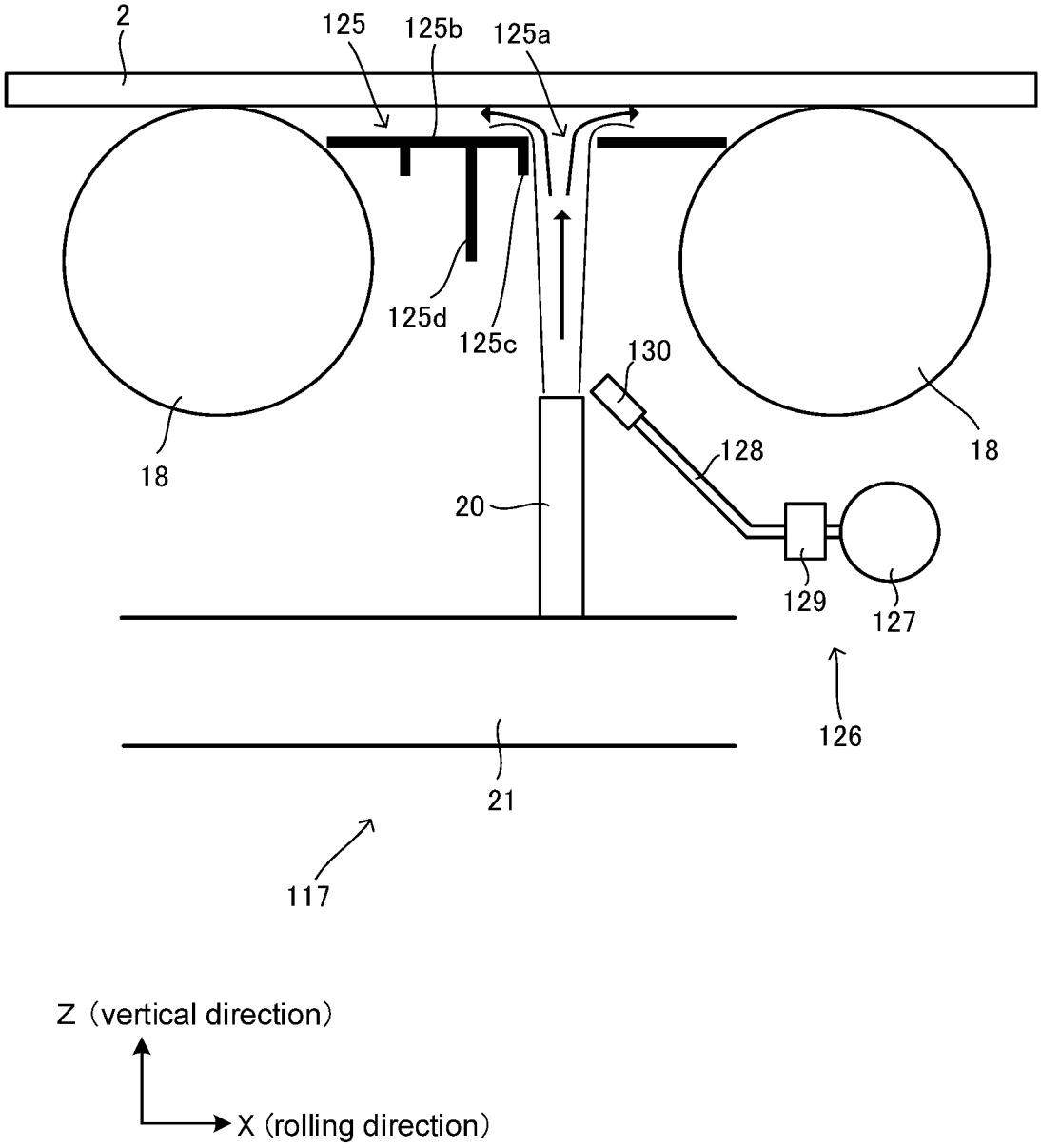
FIG. 17 is an explanatory view of structure of a cooling water moving direction changing device 126.
Figure 18:
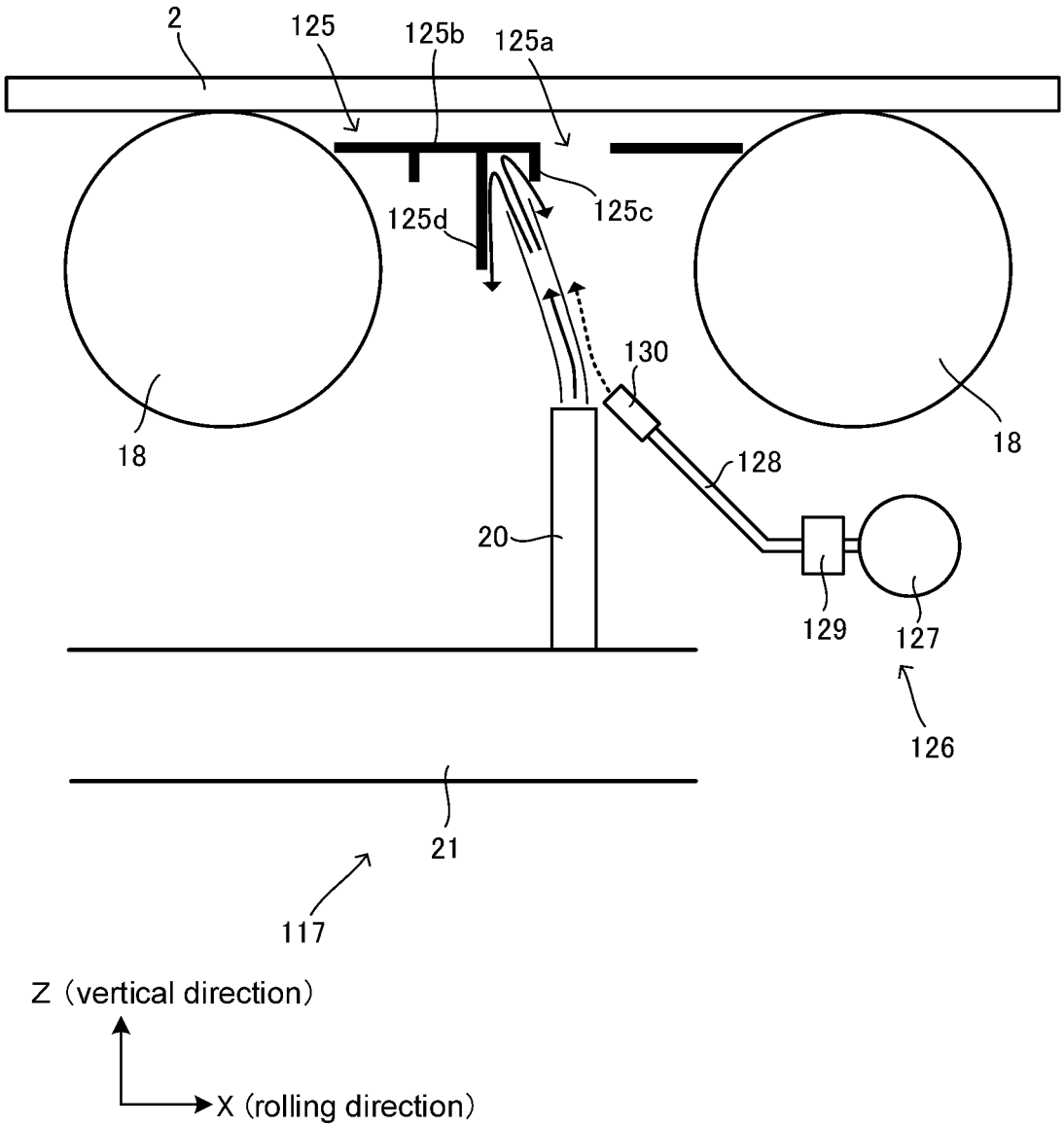
FIG. 18 is another explanatory view of the structure of the cooling water moving direction changing device 126.

FIGS. 17 and 18 are explanatory views illustrating an example of a switching mechanism according to the second embodiment which includes the cooling water moving direction changing device 126. FIGS. 17 and 18 focus on the periphery of one of the cooling water nozzles 20 arranged between the transport rolls 18.

Each switching mechanism in this example includes the guide plate 125 and the cooling water moving direction changing device 126.

The guide plate 125 is a platelike member arranged between the middle headers 21 and the divided cooling sections A3. The guide plate 125 is designed to have strength enough to bear an impact of the front end of the hot rolled steel sheet 2 when the hot rolled steel sheet 2 passes through and impinges on any guide plate 125. Each of the guide plates 125 is at least arranged in every interval between adjacent transport rolls 18, which makes it possible to prevent the front end of the hot rolled steel sheet 2 from being caught by any cooling water nozzle 20, middle header 21, and transport roll 18 especially when the hot rolled steel sheet 2 passes through.

A jet outlet 125*a* is provided for the guide plate 125. The jet outlet 125*a* allows cooling water sprayed from the corresponding cooling water nozzle 20 to pass therethrough when no gas is sprayed from the cooling water moving direction changing device 126. This makes it possible for cooling water sprayed from the cooling water nozzle 20 to pass through the guide plate 125 and to impinge on the corresponding divided cooling section A3, and thus suitable cooling can be carried out. A draining hole allowing discharged water to pass therethrough may be provided for the guide plate 125.

The distance between the upper surfaces of the guide plate 125 and the divided cooling sections A3 is not specifically limited, and for example, may be approximately 20 mm.

The guide plate 125 includes a piece 125*b* having the jet outlet 125*a* and formed in parallel to the rolling direction, and draining plates 125*c* and 125*d* provided as hanging down from the undersurface of the piece 125*b*. The draining plate 125*c* is provided closer to the jet outlet 125*a* than the draining plate 125*d* is.

The draining plates 125*c* and 125*d* prevent cooling water sprayed from the cooling water nozzle 20 from scattering over the jet outlet 125*a* after the cooling water impinges on the piece 125*b* when the cooling water moving direction changing device 126 sprays gas. The draining plates 125*c* and 125*d* further suppress cooling water blown from the jet outlet 125*a* to the steel sheet transport zone side by the flow of sprayed gas impinging on the divided cooling section A3.

The draining plate 125*d* also has a function of preventing cooling water sprayed from the cooling water nozzle 20 from scattering over the cooling water nozzle 20 after the cooling water impinges on the piece 125*b* when the cooling water moving direction changing device 126 sprays gas, to prevent the cooling water from interfering with a jet of cooling water sprayed from the cooling water nozzle 20. The draining plate 125*d* is disposed so as not to prevent a jet of cooling water sprayed from the cooling water nozzle 20 and the flow of gas sprayed from the cooling water moving direction changing device 126.

Here, too long a draining plate 125*c* causes direct impingement of a jet of cooling water thereon, to increase the quantity of cooling water blown from the jet outlet 125*a* to the steel sheet transport zone side. Thus, it is desirable that the length of the draining plate 125*c* be approximately 10 mm to 30 mm.

In contrast, the draining plate 125*d* may have any length as long as interference as described above can be sufficiently prevented. It is desirable that the length of the draining plate 125*d* be approximately 50 mm to 150 mm.

The cooling water moving direction changing device 126 is a device spraying gas over cooling water sprayed from the cooling water nozzle 20 to change the moving direction of the cooling water. The cooling water moving direction changing device 126 includes a gas header 127, a gas branch 128, a valve 129 and a gas nozzle 130.

Gas sprayed from the gas nozzle 130 changes the moving direction of cooling water sprayed from the cooling water nozzle 20, to control the cooling water impinging and not impinging on the divided cooling section A3.

More specifically, the gas nozzle 130 is connected to the gas header 127 via the gas branch 128. Gas of a predetermined pressure (for example, air) is supplied from the gas header 127. The valve 129 is attached in the middle of the gas branch 128.

The valve 129 controls start of spraying gas from the gas nozzle 130 and stop of the spraying based on signals from the controller 27. Examples of such a valve include a solenoid valve. Arranging the gas nozzles 130 correspondingly to the number of the cooling water nozzles 20 included in each divided cooling section A3 makes it possible to control cooling water impinging and not impinging on the undersurface of the steel sheet transport zone for each divided cooling section A3.

The gas nozzle 130 is disposed in the vicinity of the cooling water nozzle 20 as seen from FIGS. 17 and 18. Gas is sprayed from the gas nozzle 130 as the gas nozzle 130 is inclined at an angle of approximately 15 to 30 degrees with respect to the vertical direction, which makes it possible to effectively change the moving direction of a jet of cooling water with a comparatively small flow volume of gas.

It is desirable to use, as the gas nozzle 130, a flat air nozzle generating a fan-shaped jet whose impact force is comparatively difficult to weaken even as an object to be impacted is some distance away therefrom. At this time, too wide a spread angle of a fan-shaped jet sprayed from the gas nozzle 130 causes an impact force when the fan-shaped jet impacts a jet of cooling water to severely weaken. Thus, it is desirable to adjust a sprayed fan-shaped jet so that the fan-shaped jet just covers a jet of cooling water in all over the width direction.

As shown in FIG. 17, when the valve 129 is closed and gas is not sprayed from the gas nozzle 130, cooling water sprayed from the cooling water nozzle 20 passes through the jet outlet 125*a* and impinges on the divided cooling section A3, which makes it possible to cool the hot rolled steel sheet 2. In FIG. 17, arrows of solid lines with black triangles at their top ends represent the directions of the flow of cooling water sprayed from the cooling water nozzle 20.

In contrast, FIG. 18 is a schematic view of the same viewpoint as FIG. 17, which illustrates a scene where gas is sprayed from the gas nozzle 130. In FIG. 18, the arrow of a dotted line with a black triangle at its top end represents the direction of the flow of gas sprayed from the gas nozzle 130.

Specific aspects of operating the valve 129 so that cooling water is prevented from impinging on the divided cooling section A3 include changing the moving direction of a jet of cooling water sprayed from the cooling water nozzle 20 so that the jet of the cooling water does not impinge on the divided cooling section A3.

The valve 129 operates in response to signals from the controller 27, to allow gas to be sprayed from the gas nozzle 130 onto a jet of cooling water sprayed from the cooling water nozzle 20. Whereby, the jet of cooling water sprayed from the cooling water nozzle 20 is forced to change the direction thereof by the flow of the gas. As a result, the cooling water impinges on the undersurface of the guide plate 125, which makes it impossible for the cooling water to pass through the jet outlet 125*a*. Whereby, it can be prevented to impinge on the cooling water against the divided cooling section A3, which stops cooling hot rolled steel sheet 2.

Here, the controller 27 may control the switching mechanism as in the lower side width direction control cooling device 17 of the first embodiment as well.

According to this embodiment, any bucket or the like for recovering cooling water that is prevented from impinging on the divided cooling section A3 is not necessary since cooling water that the switching mechanism prevents from impinging on the divided cooling section A3 is prevented from impinging on the divided cooling section A3. Thus, the switching mechanism of the second embodiment is easily installed into a narrow space such as a space between adjacent transport rolls 18.

The switching mechanism of the second embodiment does not perform ON/OFF control of a jet of cooling water from the cooling water nozzle 20, but controls jets of cooling water impinging on and not impinging on the hot rolled steel sheet 2 after the cooling water is sprayed from the cooling water nozzle 20 while a certain quantity of cooling water is sprayed from the cooling water nozzle 20. Further, any shutter or the like is not operated mechanically as a means for controlling a jet of cooling water impinging and not impinging, but ON/OFF control on a jet of gas from the gas nozzle 130 is performed with the cooling water moving direction changing device 126 to control cooling water impinging and not impinging on the divided cooling section A3.

Figure 19:
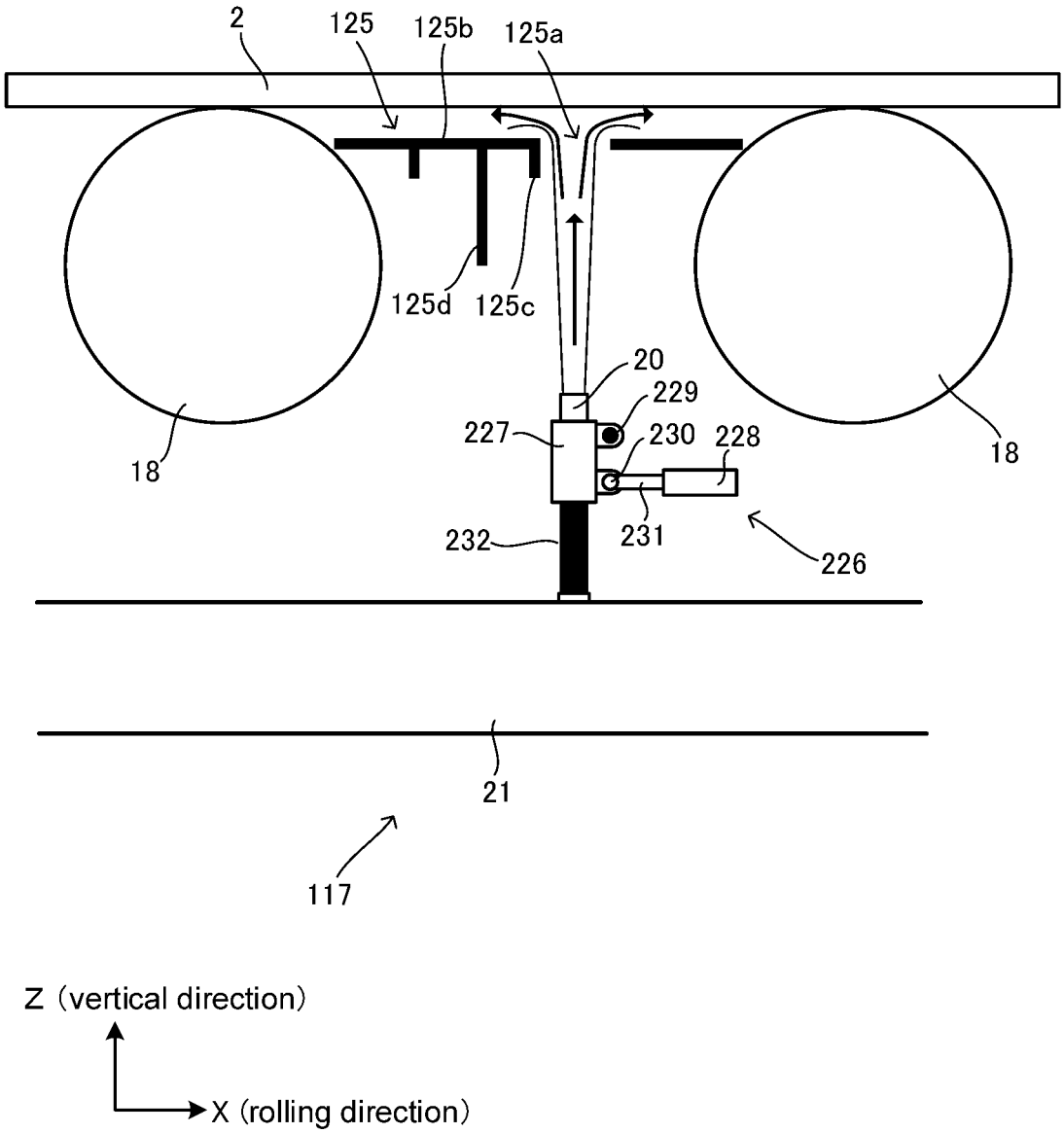
FIG. 19 is an explanatory view of structure of a cooling water moving direction changing device 226.
Figure 20:
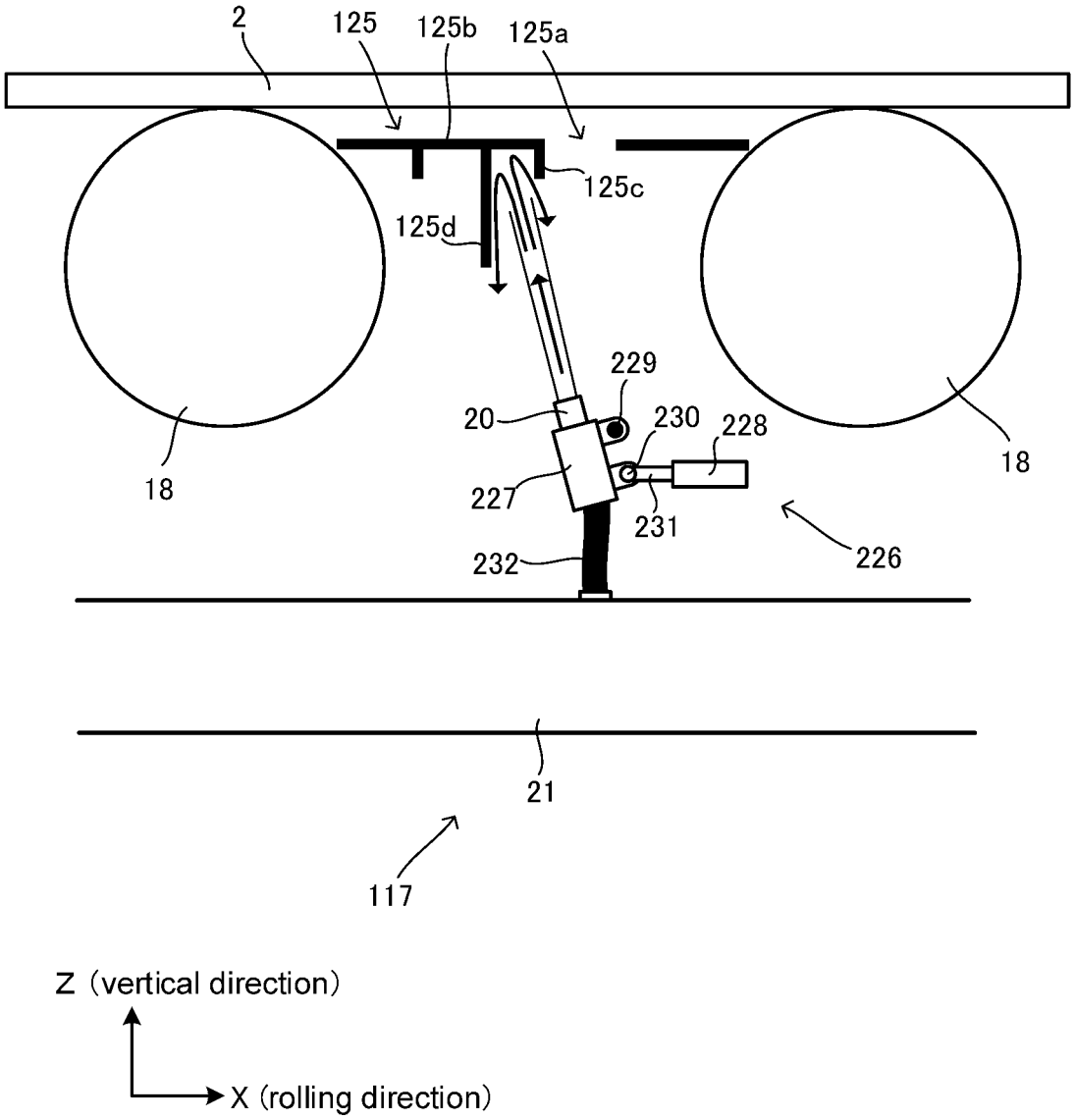
FIG. 20 is another explanatory view of the structure of the cooling water moving direction changing device 226.

FIGS. 19 and 20 schematically illustrate part of the lower side width direction control cooling device 117 according to a variation of the second embodiment. FIG. 19 corresponds to FIG. 17 and FIG. 20 corresponds to FIG. 18.

The switching mechanism using the cooling water moving direction changing device 226 instead of the cooling water moving direction changing device 126 of the switching mechanism is employed for the lower side width direction control cooling device 117 illustrated in FIGS. 19 and 20. Thus, here, the cooling water moving direction changing device 226 will be described.

Each of the cooling water moving direction changing devices 226 includes a nozzle adaptor 227 and an air cylinder 228. The nozzle adaptor 227 is attached to the corresponding cooling water nozzle 20 so as to be rotatable around a fixed axis 229. The fixed axis 229 is fixed by a support member not shown so as not to shift the position thereof. A piston rod 231 of the air cylinder 228 is connected to the nozzle adaptor 227 via a rod point axis 230 so as to be rotatable around the rod point axis 230.

Thus, moving the air cylinder 228 makes it possible to incline the cooling water nozzle 20. That is, cooling water can be sprayed upwards in the vertical direction when the cooling water nozzle 20 is in the posture illustrated in FIG. 19, and moving the air cylinder 228 makes it possible to incline the cooling water nozzle 20 at a predetermined angle with respect to the vertical direction as shown in FIG. 20.

The nozzle adaptor 227 is attached to each of the cooling water nozzles 20. The air cylinder 228 is attached to each of the nozzle adaptors 227. The air cylinder 228 can be operated by a solenoid valve not shown. The solenoid valve opens and closes in response to signals from the controller 27, whereby the posture of the corresponding cooling water nozzle 20 is controlled via the air cylinder 228 to be directed either vertically or obliquely with respect to the vertical direction as described above.

When the cooling water nozzle 20 is controlled to be directed vertically as shown in FIG. 19, a jet of cooling water passes through the jet outlet 125*a* provided for the guide plate 125, and impinges on the corresponding divided cooling section A3. In contrast, when the cooling water nozzle 20 is controlled to be in the posture oblique with respect to the vertical direction as shown in FIG. 20, the direction of a jet of cooling water changes as much as the cooling water nozzle 20 inclines, and the jet impinges on the undersurface of the guide plate 125. The cooling water does not impinge on the divided cooling section A3.

As described above, the solenoid valve is operated in response to signals from the controller 27, to change the posture of the cooling water nozzle 20, and to change the direction of cooling water sprayed from the cooling water nozzle 20, which makes it possible to switch between the posture such that the cooling water is prevented from impinging on the divided cooling section A3 and the posture such that the cooling water is not prevented from impinging on the divided cooling section A3.

Connecting any middle header 21 and the nozzle adaptor 227 via a flexible tube (such as a rubber tube) 232 makes it possible for deformation of the flexible tube 232 to absorb a relative positional shift between them when the cooling water nozzle 20 inclines as described above.

An angle of inclining the cooling water nozzle 20 is necessarily adjusted so that almost all the jet of cooling water impinges on the undersurface of the guide plate 125. In contrast, for shortening the response time, it is preferable to make an angle of inclining the cooling water nozzle 20 as narrow as possible. From these viewpoints, it is desirable to make a design so that almost all the jet of cooling water impinges on the undersurface of the guide plate 125 when the cooling water nozzle 20 is inclined at an angle of approximately 5 to 10 degrees with respect to the vertical direction.

Figure 21:
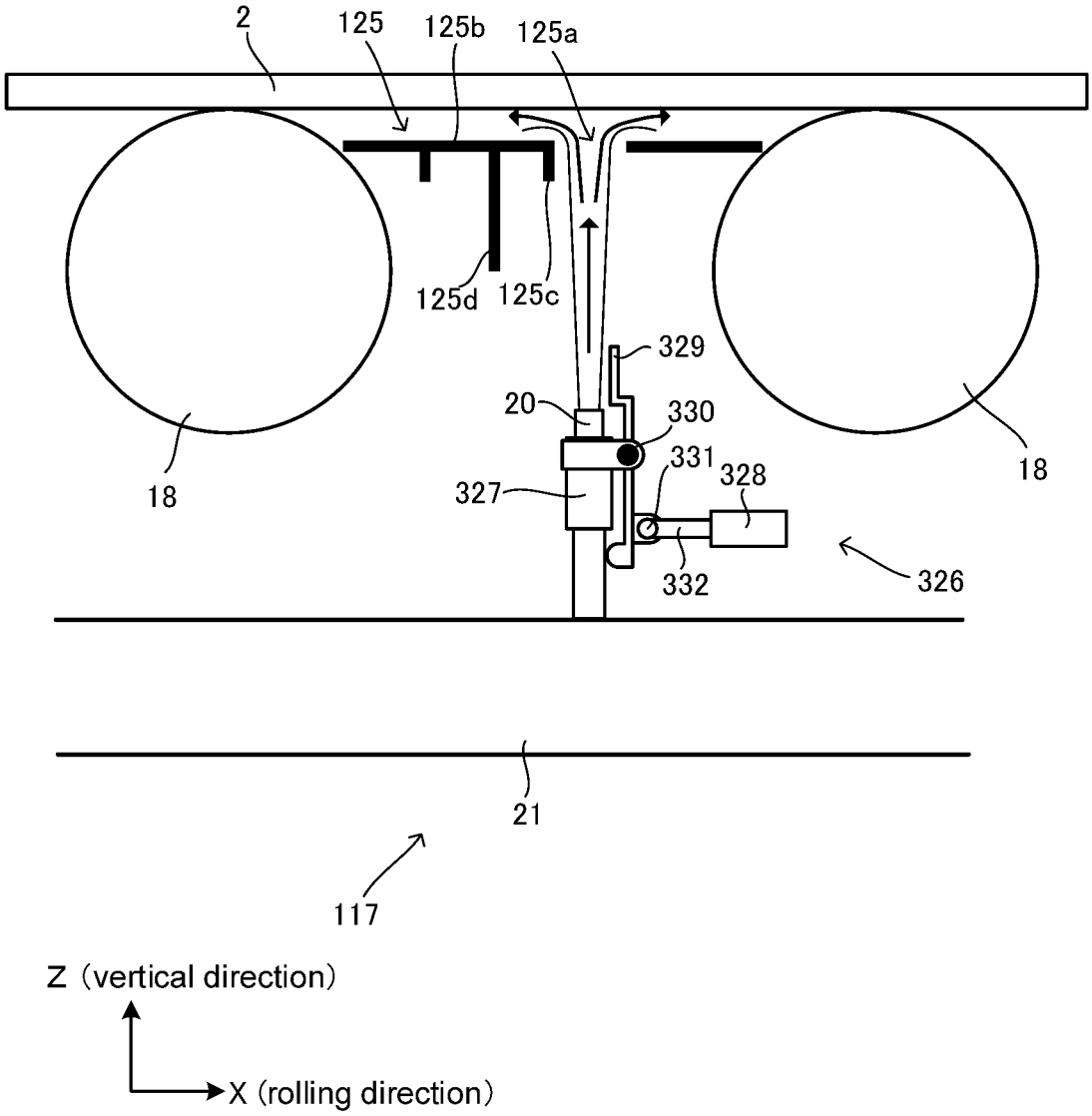
FIG. 21 is an explanatory view of structure of a cooling water moving direction changing device 326.
Figure 22:
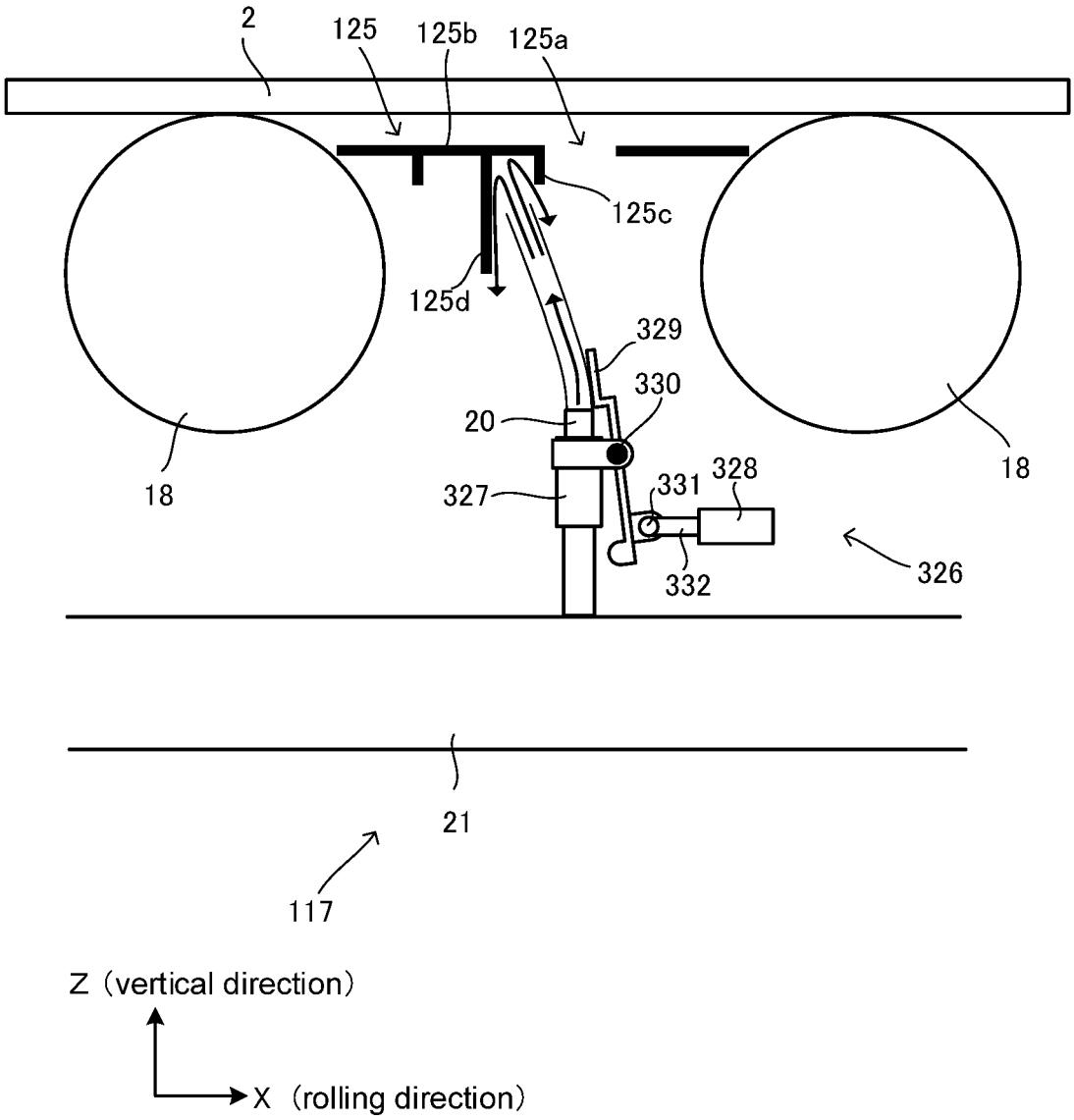
FIG. 22 is another explanatory view of the structure of the cooling water moving direction changing device 326.

FIGS. 21 and 22 schematically illustrate part of the lower side width direction control cooling device 117 according to another variation of the second embodiment. FIG. 21 corresponds to FIG. 17 and FIG. 22 corresponds to FIG. 18.

In the switching mechanism illustrated in FIGS. 21 and 22, the cooling water moving direction changing device 326 is used instead of the cooling water moving direction changing device 126. Thus, here, the cooling water moving direction changing device 326 will be described.

Each of the cooling water moving direction changing devices 326 includes a nozzle adaptor 327, an air cylinder 328, and a jet deflection plate 329. The nozzle adaptor 327 is attached to the corresponding cooling water nozzle 20. The jet deflection plate 329 is attached to the nozzle adaptor 327 so as to be rotatable around a rotation axis 330. A piston rod 332 of the air cylinder 328 is connected to the jet deflection plate 329 via a rod point axis 331 so as to be rotatable around the rod point axis 331.

Thus, moving the air cylinder 328 makes it possible to incline the jet deflection plate 329. That is, the jet deflection plate 329 is at a position where cooling water sprayed from the cooling water nozzle 20 does not impinge in the posture thereof illustrated in FIG. 21. Moving the air cylinder 328 makes it possible to incline the jet deflection plate 329 at a predetermined angle with respect to the vertical direction so that cooling water sprayed from the cooling water nozzle 20 impinge on the jet deflection plate 329 as shown in FIG. 22.

The nozzle adaptor 327 is attached to each of the cooling water nozzles 20. The air cylinder 328 is attached to each of the nozzle adaptors 327. The air cylinder 328 can be operated by a solenoid valve not shown. The solenoid valve opens and closes in response to signals from the controller 27, whereby the posture of the jet deflection plate 329 is controlled via the air cylinder 328 to be directed either vertically or obliquely with respect to the vertical direction as described above.

As shown in FIG. 21, when the jet deflection plate 329 is controlled to be directed vertically, a jet of cooling water passes through the jet outlet 125*a* provided for the guide plate 125, and impinges on the corresponding divided cooling section A3. In contrast, as shown in FIG. 22, when the jet deflection plate 329 is controlled to be in the posture oblique with respect to the vertical direction, cooling water sprayed from the cooling water nozzle 20 is bent by the jet deflection plate 329, the direction of a jet of the cooling water changes, and the jet impinges on the undersurface of the guide plate 125. The cooling water does not impinge on the divided cooling section A3.

As described above, the solenoid valve is operated in response to signals from the controller 27, to change the posture of the jet deflection plate 329, and to change the direction of cooling water sprayed from the cooling water nozzle 20, which makes it possible to switch between the posture such that the cooling water is prevented from impinging on the divided cooling section A3 and the posture such that the cooling water is not prevented from impinging on the divided cooling section A3.

An angle of inclining the jet deflection plate 329 is necessarily adjusted so that almost all the jet of cooling water impinges on the undersurface of the guide plate 125. In contrast, for shortening the response time, it is preferable to make an angle of inclining the jet deflection plate 329 as narrow as possible. From these viewpoints, it is desirable to make a design, so that the direction of the jet deflection plate 329 is changeable so that almost all the jet of cooling water impinges on the undersurface of the guide plate 125 when the jet deflection plate 329 is inclined at an angle of approximately 5 to 10 degrees with respect to the vertical direction.

Three examples of the embodiment of the cooling water moving direction changing devices have been explained so far. Among them, in a case where the direction of a jet of cooling water is changed by spraying gas, any movable part and air cylinder or the like are not necessary. Thus, a device can be made to be smaller compared with not only conventional methods of course but also the above described method of using the jet deflection plate and method of inclining the cooling water nozzle, which leads to easy installation into a narrow space. Unnecessity of any movable part and air cylinder or the like is advantageous in durability as well. While it can be predicted however that the gas (air) consumption increases, which leads to a disadvantage in the cost, the volume of necessary gas (air) is largely reduced compared to conventional methods since an angle at which the direction of a jet of cooling water should be changed may be slighter compared to the case where a jet of cooling water is completely blocked or the direction thereof is largely changed as in conventional methods, and as a result a cost for installing a compressor etc. and running costs are reduced.

Since only a slight change in the direction of a jet of cooling water is necessary as well when the above described jet deflection plate is used, force applied to the jet deflection plate is approximately 10% to 20% of (sin θ times as much as; θ represents an angle changing in the direction of a jet of cooling water) that in the case where a jet of cooling water is completely blocked or the direction thereof is largely changed as in conventional methods. Therefore, repeatedly received impact loads can be largely reduced, which makes it possible to lower strength necessary for any movable part in the device. Whereby, a large weight reduction can be achieved and required thrust of the air cylinder is lowered, which makes it possible to shorten the cylinder diameter. The air consumption is also reduced to eliminate running costs. Further, an impact load applied when the air cylinder reciprocates is also lowered, which makes it possible to largely improve durability compared to conventional methods.

The description concerning the second embodiment illustrates the example of changing the direction of a jet of cooling water after the cooling water is sprayed from the cooling water nozzle 20, to control the jet of the cooling water impinging and not impinging on the divided cooling section A3. The second embodiment is not restricted to this. For example, one may move the guide plate in the rolling direction, or combine changing the direction of a jet of cooling water after the cooling water is sprayed from the cooling water nozzle and moving the guide plate in the rolling direction, to control the jet of the cooling water impinging and not impinging on the divided cooling section.

The descriptions concerning the first and second embodiments illustrate controlling, using the controller, the number of the switching mechanisms operating so that cooling water impinges on the divided cooling sections, and the description concerning the second embodiment illustrates controlling, using the controller, the number of the cooling water nozzles spraying cooling water to impinge on the divided cooling sections. The present invention is not restricted to them. For example, the quantity of cooling water sprayed from the cooling water nozzles may be controlled in addition to control of the number of the switching mechanisms and the number of the cooling water nozzles. The quantity of cooling water may be controlled using a flow regulation valve. In this case, a flow regulation valve may be provided between the middle headers and the switching mechanism.

When spray nozzles are used as the cooling water nozzles, each spray nozzle may be configured so that the distance between the top of the spray nozzle and the steel sheet can be changed. Whereby, an impact pressure of a jet of cooling water impinging on the steel sheet can be controlled, which makes it easy to control the cooling temperature.

EXAMPLES

Hereinafter effect of the present invention will be described based on Examples and Comparative Examples. The present invention is not restricted to these Examples.

Example

For verifying the effect, the lower side width direction control cooling device 17 illustrated in FIG. 2 was used as a cooling device of Example 1. Not the lower side width direction control cooling device 17 but a conventional lower side cooling device 16 was employed as a cooling device of Comparative Example 1.

Conditions for this verification were as follows: operation conditions in Example 1 were; steel sheet width: 1300 mm, sheet thickness: 3.2 mm, steel sheet transport speed: 600 mpm, temperature before cooling: 900° C., and target winding temperature: 550° C. The switching mechanism of the first embodiment was utilized in the lower side width direction control cooling device. While two middle headers are provided in the rolling direction and four cooling water nozzles are arranged for each middle header in FIG. 4, four middle headers were provided in the rolling direction and two cooling water nozzles were disposed for each middle header in Example 1. The cooling length in the rolling direction was as long as eight pitches between transport rolls as well as FIG. 4. The speed of the response including those of the three way valves and the piping system was 0.2 seconds. The flow density of cooling water to be sprayed was 2 $m^3/m^2/min$. A position where the lower side width direction control cooling device was installed was on the side closer to the winding device (downstream side of the lower side cooling device).

In contrast, in operation conditions in Comparative Example 1, no cooling control function in the sheet width direction was provided, and the flow density of the cooling water to be sprayed was 0.7 $m^3/m^2/min$.

Figure 23:
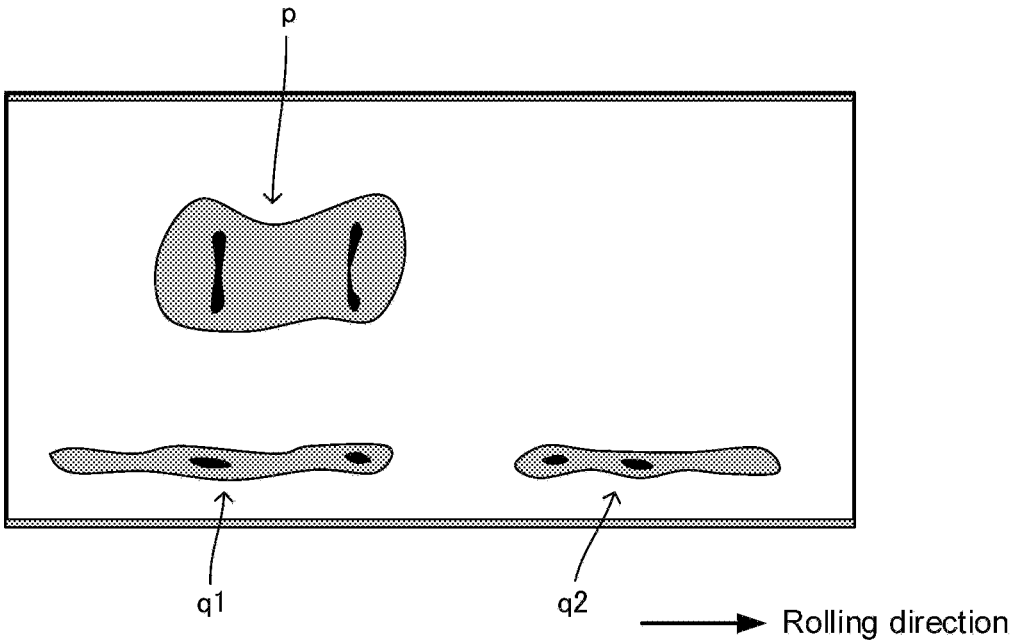
FIG. 23 partially illustrates a temperature distribution on the upper surface of a steel sheet in Comparative Example 1.
Figure 24:
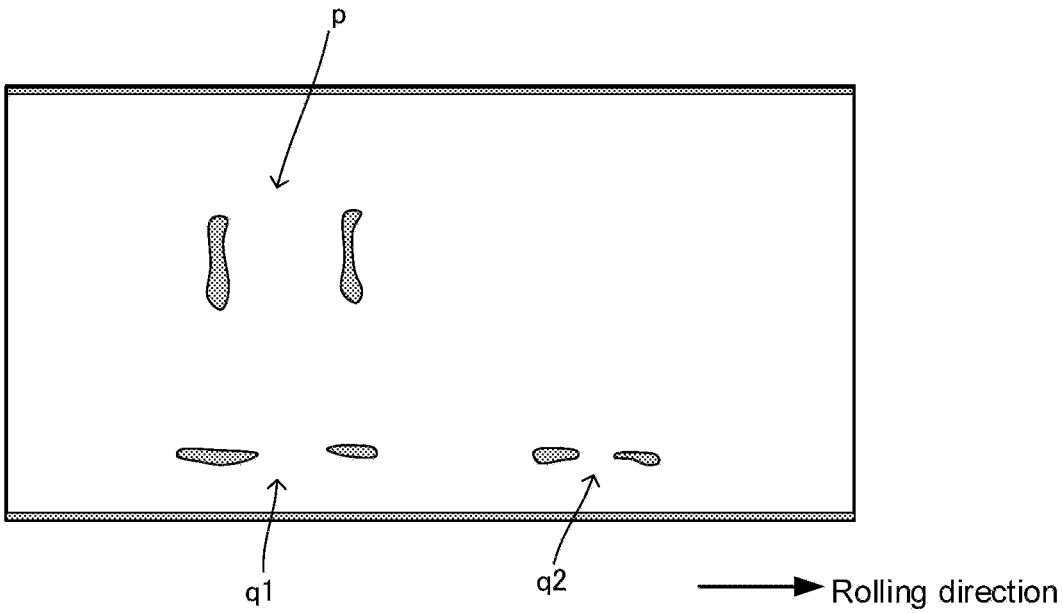
FIG. 24 partially illustrates a temperature distribution on the upper surface of a steel sheet in Example 1.

FIG. 23 illustrates an example of a partially extracted temperature distribution over the upper surface of the steel sheet in Comparative Example 1. In FIG. 23, only distribution especially at lower temperatures than the target temperature is indicated by gradation for an easy distinction on the temperature distribution display (which is also applied to FIG. 24 shown later). Pale black portions are portions 30° C. to 15° C. lower than the target temperature, and dark black portions are portions 30° C. or more lower than the target temperature. As shown in FIG. 23, in Comparative Example 1, a comparatively large low temperature portion p was generated on the center part in the sheet width direction. Stripes of low temperature portions q1 and q2 extending in the rolling direction were also generated.

According to Comparative Example 1, the standard temperature deviation was 23.9° C. The standard temperature deviation was calculated from all the points of temperature measurement of the steel sheet excluding a portion 10 m from the front and tail ends, and 50 mm from both sides from the result of measurement with an infrared thermography.

FIG. 24 illustrates an example of a partially extracted temperature distribution over the upper surface of the steel sheet in Example 1. As is seen from FIG. 24, it is found that all the low temperature portions p, q1 and q2 in Example 1 are smaller than those in Comparative Example 1.

According to Example 1, the standard temperature deviation was 8.8° C. Thus, it was found that according to the present invention, the temperature of the hot rolled steel sheet in the sheet width direction can be made to be uniform.

Example 2

Operation conditions were same as Example 1. The cooling length of a lower side width direction control cooling device in the rolling direction was as long as eight pitches between transport rolls as well as Example 1. The lower side width direction control cooling device uses the cooling water moving direction changing devices 126 as a cooling water moving direction changing device in the switching mechanism in the second embodiment. One switching mechanism was disposed for each divided cooling section A3 as shown in FIG. 10. The response speed was 0.18 seconds. The flow density of cooling water to be sprayed was 2 $m^3/m^2/min$. A position where the lower side width direction control cooling device was installed was on the side closer to the winding device (downstream side of the lower side cooling device).

According to Example 2, the same results of the temperature distribution all over the cooled hot rolled steel sheet as in FIG. 24 could be obtained. The standard temperature deviation was 8.6° C.

REFERENCE SIGNS LIST

1 slab
2 hot rolled steel sheet
10 hot rolling system
11 heating furnace
12 width direction rolling mill
13 rough rolling mill
14 finish rolling mill
15 upper side cooling device
16 lower side cooling device
17 lower side width direction control cooling device
18 transport roll
19 winding device
20 cooling water nozzle
21 middle header
23 piping
24 three way valve
25 water supply header
26 draining header
27 controller
30 upstream side temperature measurement device
31 downstream side temperature measurement device
32 radiation thermometer
33 optical fiber
34 nozzle
35 water tank
40 jet hole
117 lower side width direction control cooling device
125 guide plate
125*a* jet outlet
125*c*, 125*d* draining plate
126, 226, 326 cooling water moving direction changing device
127 gas header
128 gas branch
129 valve
130 gas nozzle
227, 327 nozzle adaptor
228, 328 air cylinder
229 fixed axis
230, 331 rod point axis
231, 332 piston rod
232 tube
329 jet deflection plate
330 rotation axis

The invention claimed is:

1. A cooling device cooling an undersurface of a hot rolled steel sheet that is being transported on transport rolls after finish rolling of a hot rolling step, the cooling device comprising:

width divided cooling zones that are a plurality of cooling zones into which a whole cooling zone is divided in a sheet width direction, the whole cooling zone being a cooling zone partitioned by all of a width of an undersurface of a steel sheet transport zone in the sheet width direction and a length of the undersurface of the steel sheet transport zone in a rolling direction;

divided cooling sections that are a plurality of cooling zones into which each of the width divided cooling zones is divided in the rolling direction;

at least one cooling water nozzle arranged correspondingly to each of the divided cooling sections, each of said at least one cooling water nozzles spraying cooling water over the undersurface of the respective divided cooling sections;

a switching mechanism switching the cooling water sprayed from the cooling water nozzles between impinging and not impinging on the divided cooling sections;

a width direction thermometer measuring a temperature distribution in the sheet width direction of the hot rolled steel sheet, the width direction thermometer being provided on at least one of an upstream side and a downstream side of the whole cooling zone in the rolling direction in a close vicinity to the whole cooling zone, the width direction thermometer being provided for each of the width divided cooling zones on a side of the undersurface of the steel sheet transport zone; and a controller controlling operation of the switching mechanism based on a result of measurement with the width direction thermometer, wherein the switching mechanism comprises:

a water supply header supplying the cooling water, the water supply header being provided for piping in which the cooling water supplied to the cooling water nozzles flows;

a middle header extending in the rolling direction for each of divided cooling sections, said at least one cooling water nozzle being disposed therein in the rolling direction, and a valve arranged between the water supply header and the middle header, wherein the valve is a three way valve, the valve being provided on a side of the transport rolls in the sheet width direction, the valve being arranged at a same height as tops of the cooling water nozzles, and wherein the controller controls open and close of the valve based on the result of said measuring the temperature distribution of the hot rolled steel sheet in the width direction, to control the cooling water from the cooling water nozzles impinging and not impinging on the divided cooling sections included in the width divided cooling zones for each of the divided cooling sections, so that cooling of the whole of the width divided cooling zones in the rolling direction is controlled, to control cooling of the hot rolled steel sheet in the whole cooling zone.

2. The cooling device according to claim 1, wherein number of the cooling water nozzles arranged for each of the divided cooling sections are different between adjacent divided cooling sections in the rolling direction.

3. The cooling device according to claim 1, wherein each of the divided cooling sections included in one of the width divided cooling zones has a length and each of the lengths of the divided cooling sections included in one of the width divided cooling zones is different from each other in the rolling direction.

4. The cooling device according to claim 1, wherein each of the divided cooling sections in the rolling direction has a length and each of the lengths of the divided cooling sections in the rolling direction a multiple of a length between transport rolls.

5. The cooling device according to claim 1, wherein a plurality of the cooling water nozzles in the sheet width direction are arranged in such a way that center to center distances of adjacent cooling water nozzles in the sheet width direction are all equal.

6. The cooling device according to claim 1, wherein a plurality of the cooling water nozzles for cooling each of the divided cooling sections are arranged, and the switching mechanism integratively controls a switching control system switching the cooling water from the plurality of the cooling water nozzles between impinging and not impinging on each of the divided cooling sections at once.

7. The cooling device according to claim 1, the switching mechanism comprising:

a draining header or draining area draining the cooling water;

wherein the valve switches a flow of the cooling water between the water supply header and the draining header or draining area.

8. A method for cooling an undersurface of a hot rolled steel sheet that is being transported on transport rolls after finish rolling of a hot rolling step, the method comprising:

defining a whole cooling zone as a cooling zone partitioned by all of a width of an undersurface of a steel sheet transport zone in a sheet width direction and a predetermined length of the undersurface of the steel sheet transport zone in a rolling direction, width divided cooling zones as a plurality of cooling zones into which the whole cooling zone is divided in the sheet width direction, and divided cooling sections as a plurality of cooling zones into which each of the width divided cooling zones is divided in the rolling direction;

using a structure comprising:

at least one cooling water nozzle arranged correspondingly to each of the divided cooling sections, each of said at least one cooling water nozzles spraying cooling water over undersurface of the respective divided cooling sections, a water supply header supplying the cooling water, the water supply header being provided for piping in which the cooling water supplied to the cooling water nozzles flows, a middle header extending in the rolling direction for each of the divided cooling sections, said at least one cooling water nozzle being disposed therein in the rolling direction, a valve arranged between the water supply header and the middle header, the valve being a three way valve, the valve being provided on a side of the transport rolls in the sheet width direction, the valve being arranged at a same height as tops of the cooling water nozzles:

measuring a temperature distribution of the hot rolled steel sheet in the sheet width direction on at least one of an upstream side and a downstream side of the whole cooling zone in the rolling direction in close vicinity to the whole cooling zone, for each of the width divided cooling zones on a side of the undersurface of the steel sheet transport zone; and controlling open and close of the valve based on the result of said measuring the temperature distribution of the hot rolled steel sheet in the width direction, to control the cooling water from the cooling water nozzles impinging and not impinging on the divided cooling sections included in the width divided cooling zones for each of the divided cooling sections, so that cooling of the whole of the width divided cooling zones in the rolling direction is controlled, to control cooling of the hot rolled steel sheet in the whole cooling zone.

9. The cooling method according to claim 8, wherein a plurality of the cooling water nozzles spraying the cooling water are provided for each of the divided cooling sections, and the plurality of the cooling water nozzles are integrated to control the cooling water from the plurality of the cooling water nozzles impinging and not impinging on part of the hot rolled steel sheet is controlled at once, the part being over each of the divided cooling sections.

10. The cooling method according to claim 8, the method further comprising:

using the structure further comprising:

a draining header or draining area draining the cooling water, wherein the valve switches a flow of the cooling water between the water supply header and the draining header or draining area.

11. The cooling method according to claim 8, wherein the valve supplies the cooling water to middle headers, the cooling water being supplied from the water supply header, for the middle headers each of the cooling water nozzles being provided, an opening degree of the three way valve provided for any of the middle headers that does not allow the cooling water from the cooling water nozzles to impinge on the undersurface of the hot rolled sheet is controlled so that the cooling water from the cooling water nozzles continues to flow out to the extent of not impinging on the undersurface of the hot rolled sheet; and the opening degree of the three way valve provided for any of the middle headers that allows the cooling water from the cooling water nozzles to impinge on the undersurface of the hot rolled sheet is controlled so that the cooling water from the cooling water nozzles impinging on the undersurface of the hot rolled sheet.

* * * * *